US005123145A

United States Patent [19]

Schelb et al.

[11] Patent Number: 5,123,145

[45] Date of Patent: Jun. 23, 1992

[54] METHOD AND APPARATUS FOR THE FINE CLEANING OF TEXTILE FIBERS

[75] Inventors: Heinz Schelb, Wallisellen; Paul Staheli, Wilen b. Wil; Ulf Schneider, Winterthur; Jurg Faas, Dinhard; Robert Demuth, Nurensdorf; Böhler Rolf, Schaffhausen, all of Switzerland

[73] Assignee: Rieter Machine Works Ltd., Winterthur, Switzerland

[21] Appl. No.: 585,985

[22] Filed: Sep. 21, 1990

[30] Foreign Application Priority Data

| | | | |
|---|---|---|---|
| Sep. 21, 1989 | [CH] | Switzerland | 452/89 |
| Aug. 28, 1990 | [CH] | Switzerland | 812/90 |
| Sep. 13, 1990 | [CH] | Switzerland | 980/90 |
| Sep. 13, 1990 | [CH] | Switzerland | 981/90 |

[51] Int. Cl.[5] ..... D01G 9/06

[52] U.S. Cl. ..... 19/202; 19/98; 19/205

[58] Field of Search ..... 19/58, 64, 64.5, 84, 19/93, 95, 96, 57.5, 105, 200, 202, 204, 205, 303, 306

[56] References Cited

U.S. PATENT DOCUMENTS

| | | | |
|---|---|---|---|
| T.971,001 | 6/1978 | Mangialardi | 19/202 |
| 1,182,575 | 5/1916 | Langevin | 19/95 |
| 2,825,096 | 3/1958 | Moss | 19/202 X |
| 2,825,097 | 3/1958 | Kyame | 19/96 |
| 2,827,667 | 3/1958 | Moss | 19/93 X |
| 2,948.022 | 8/1960 | Day | 19/202 X |
| 2,952,881 | 9/1960 | Moss et al. | 19/202 |
| 3,027,604 | 4/1962 | Shelburne | 19/202 |
| 3,205,537 | 9/1965 | Reiterer | 19/105 |
| 3,205.538 | 9/1965 | Miller et al. | 19/105 X |
| 3,264,689 | 8/1966 | Neitzel et al. | 19/64.5 |
| 3,457,595 | 7/1969 | Schulze | 19/204 X |
| 3,470,588 | 10/1969 | Just | 19/95 X |
| 3,854,170 | 12/1974 | Caughlin | 19/202 |
| 4,102,017 | 7/1978 | Foerster | 19/58 X |
| 4,224,720 | 9/1980 | Morgner et al. | 19/204 |
| 4,432,200 | 2/1984 | Bischofberger et al. | 57/304 |
| 4,527,307 | 7/1985 | Teichmann | 19/105 |
| 4,547,935 | 10/1985 | Jagst | 19/93 |
| 4,642,850 | 2/1987 | Giuliani | 19/105 |
| 4,654,933 | 4/1987 | Horn et al. | 19/200 |
| 4,686,744 | 8/1987 | Shofner | 19/105 X |
| 4,858,277 | 8/1989 | Pinto et al. | 19/200 |
| 5,033,166 | 7/1991 | Schmid et al. | 19/200 |

FOREIGN PATENT DOCUMENTS

| | | | |
|---|---|---|---|
| 3333618 | 4/1985 | Fed. Rep. of Germany . | |
| 3720037 | 12/1987 | Fed. Rep. of Germany . | |
| 0178018 | 2/1966 | U.S.S.R. | 19/202 |
| 0203513 | 12/1967 | U.S.S.R. | 19/105 |
| 2053995 | 2/1981 | United Kingdom . | |

*Primary Examiner*—Werner H. Schroeder
*Assistant Examiner*—Ismael Izaguirre
*Attorney, Agent, or Firm*—Sandler, Greenblum & Bernstein

[57] ABSTRACT

A method and apparatus for cleaning textile fibers for use in conjunction with an opening roller to which the textile fibers are fed and around which the textile fibers are conveyed, in the form of a fiber bat, in a transport direction. The apparatus includes an arrangement for conveying the textile fibers from an inlet to a clamping point proximate the opening roller; compressing and clamping the textile fibers, in the form of a fiber bat, with a clamping force, the clamping force having a magnitude which is a function of a characteristic of the fiber bat; drawing the fiber bat from the clamping point to a takeover point on a periphery of the opening roller, the fiber bat then being subjected to centrifugal force due to rotation of the opening roller; conveying the fiber bat, under the influence of the centrifugal force, to a separating blade; and separating an area of the fiber bat having contaminants concentrated therein resulting from the centrifugal force and from the drawing of the fiber bat.

67 Claims, 15 Drawing Sheets

P1, P2
1
P3, P4, P12
2
P3, P5, P6, P7
3
P3, P8, P9
4
P3, P13, P14, P15
5
P3, P5, P6, P7
6
P10, P11
7
P1
P2
P12
P4
P3
P5
P6
P7
P9
P8
P13
P14
P15
P10

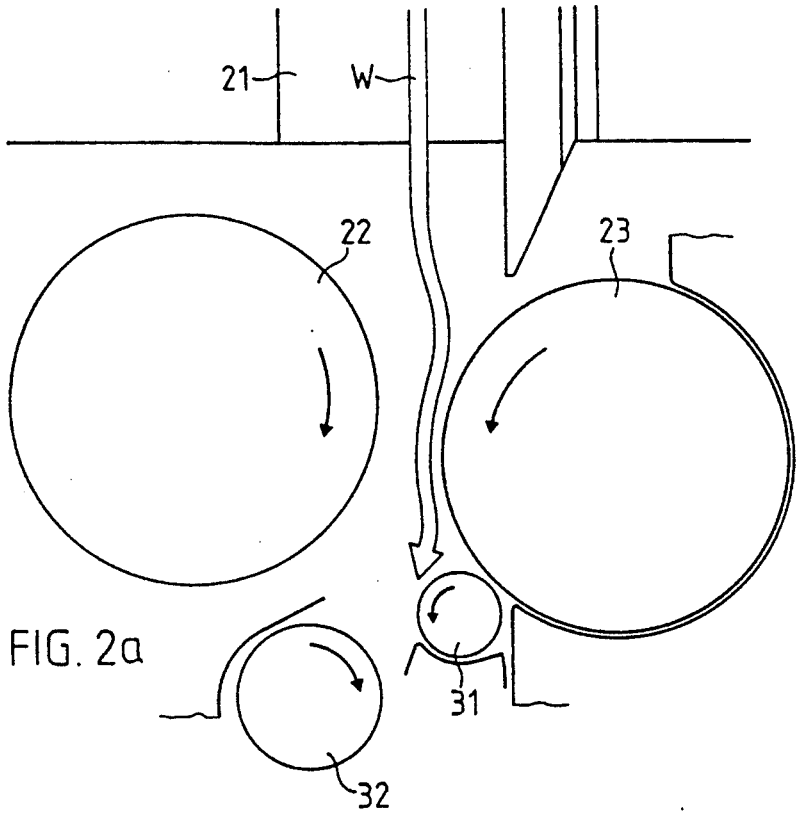
FIG. 2a
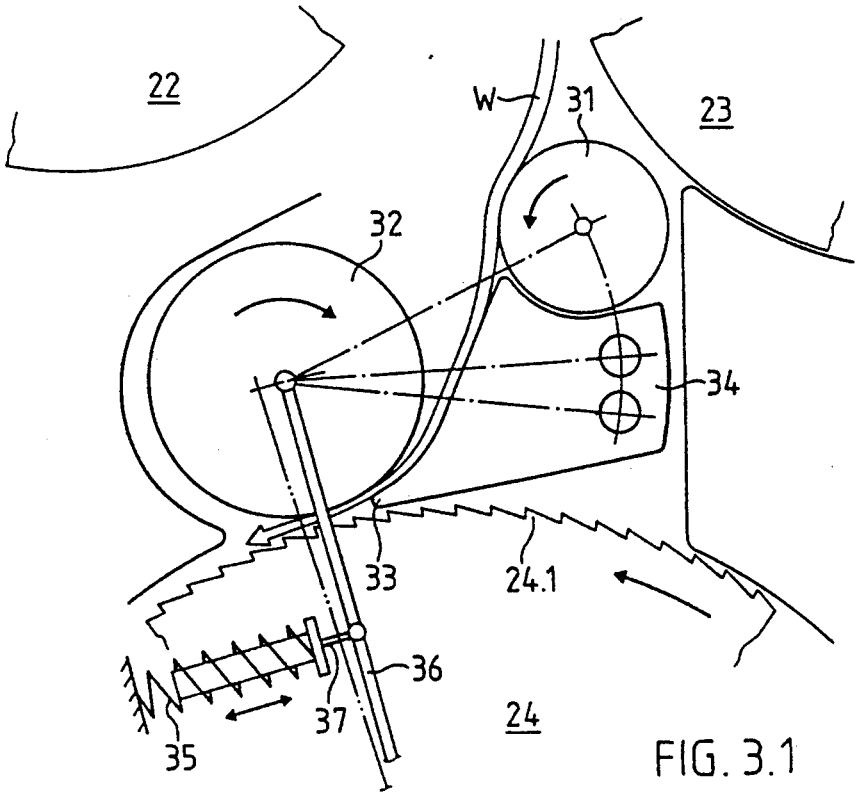
FIG. 3.1

FIG. 3.2
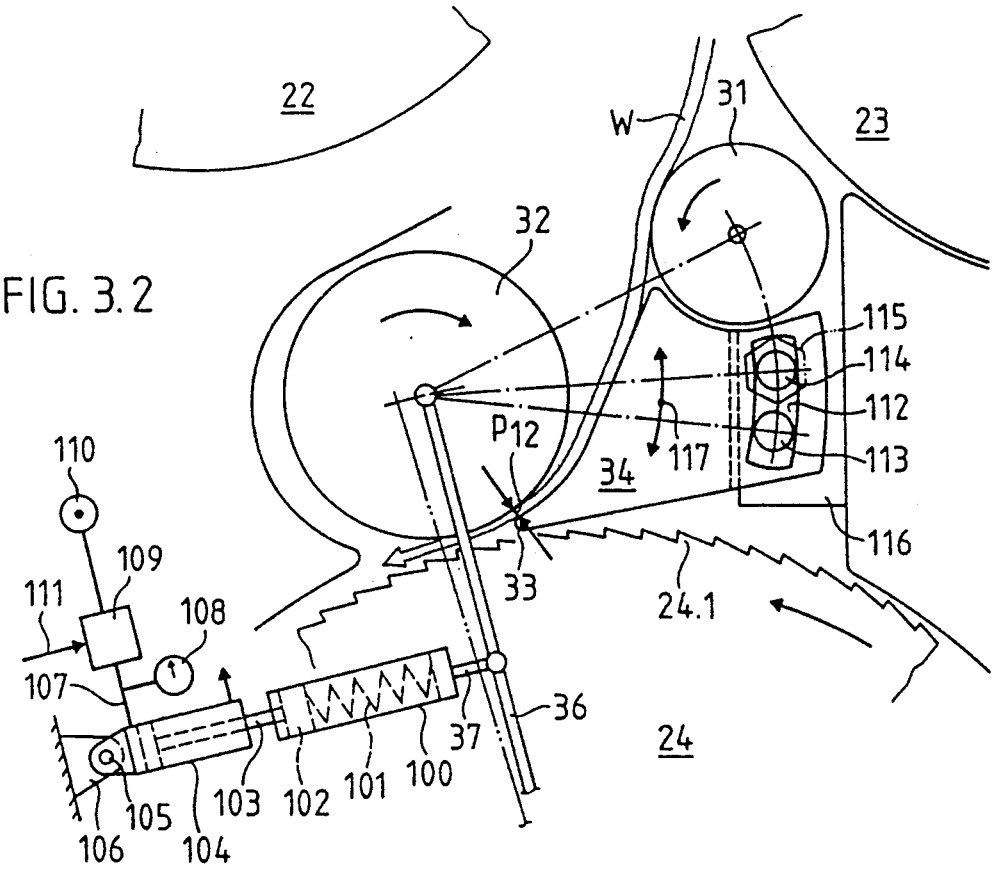
FIG. 3.3
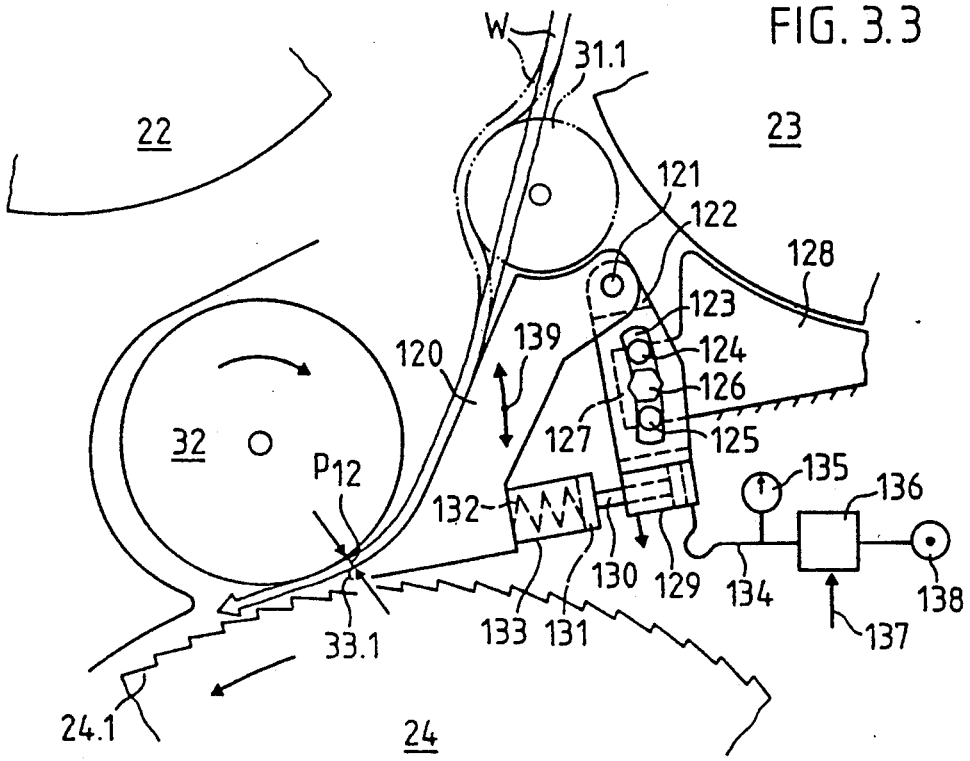

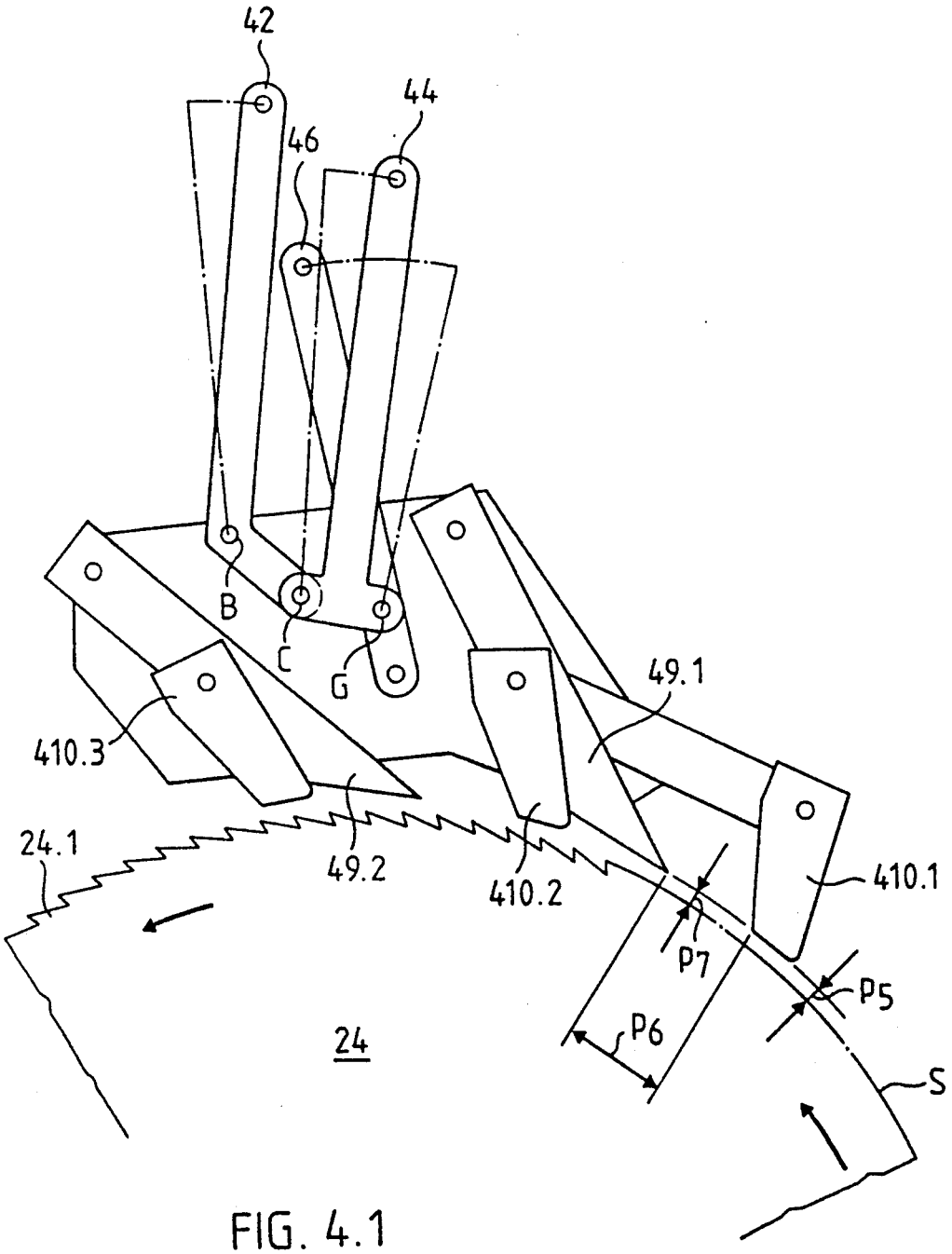
FIG. 4.1

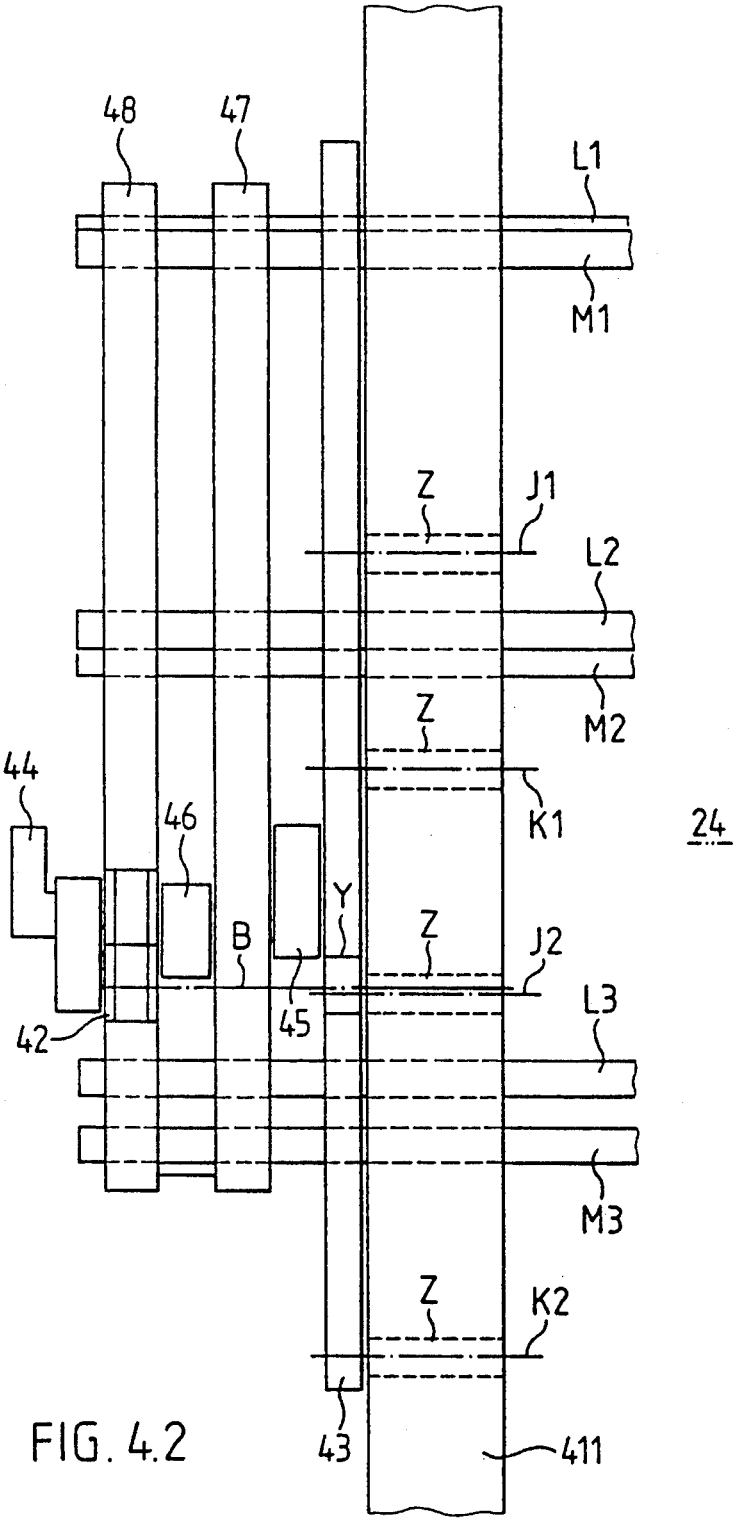
FIG. 4.2

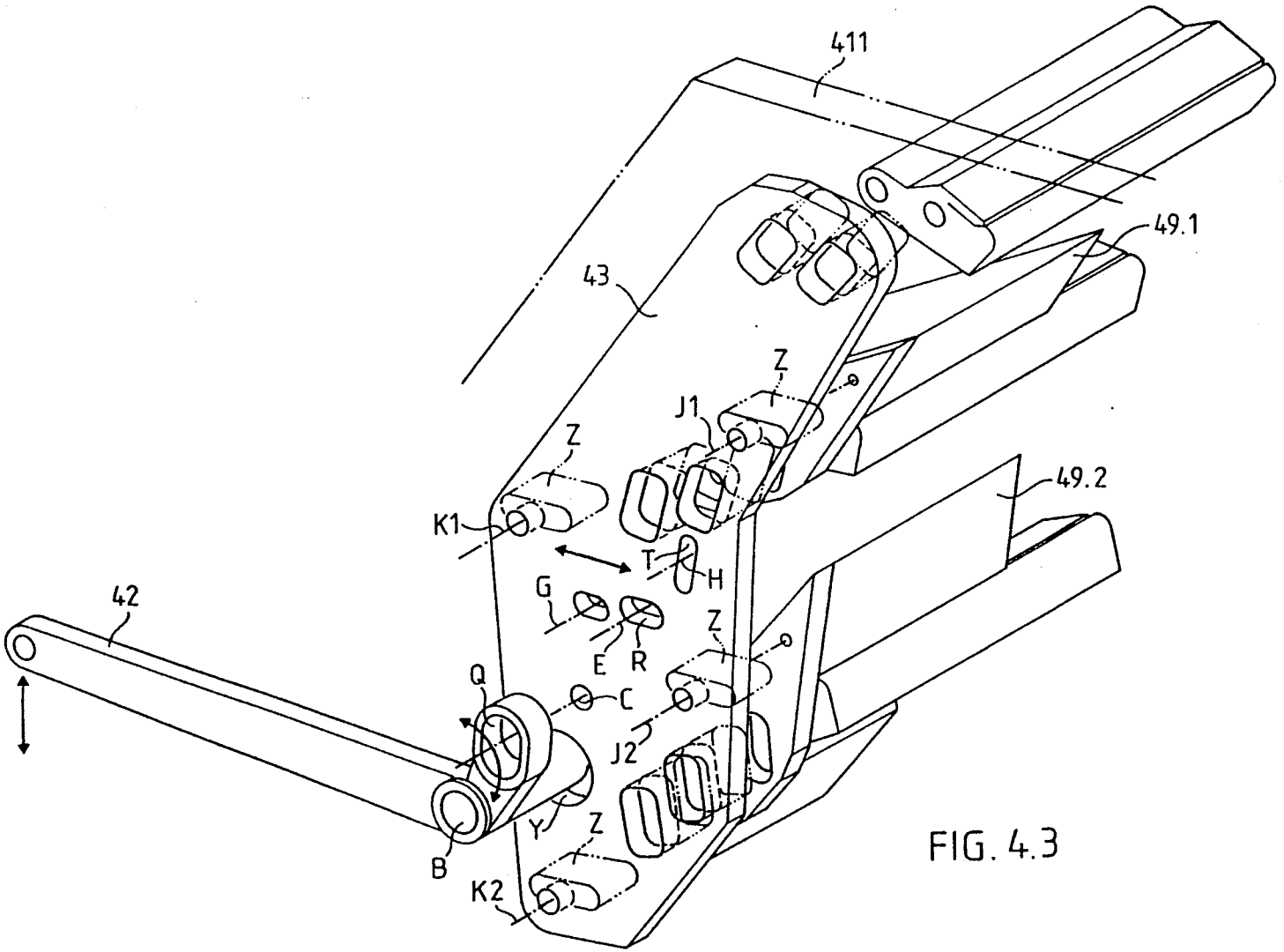
FIG. 4.3

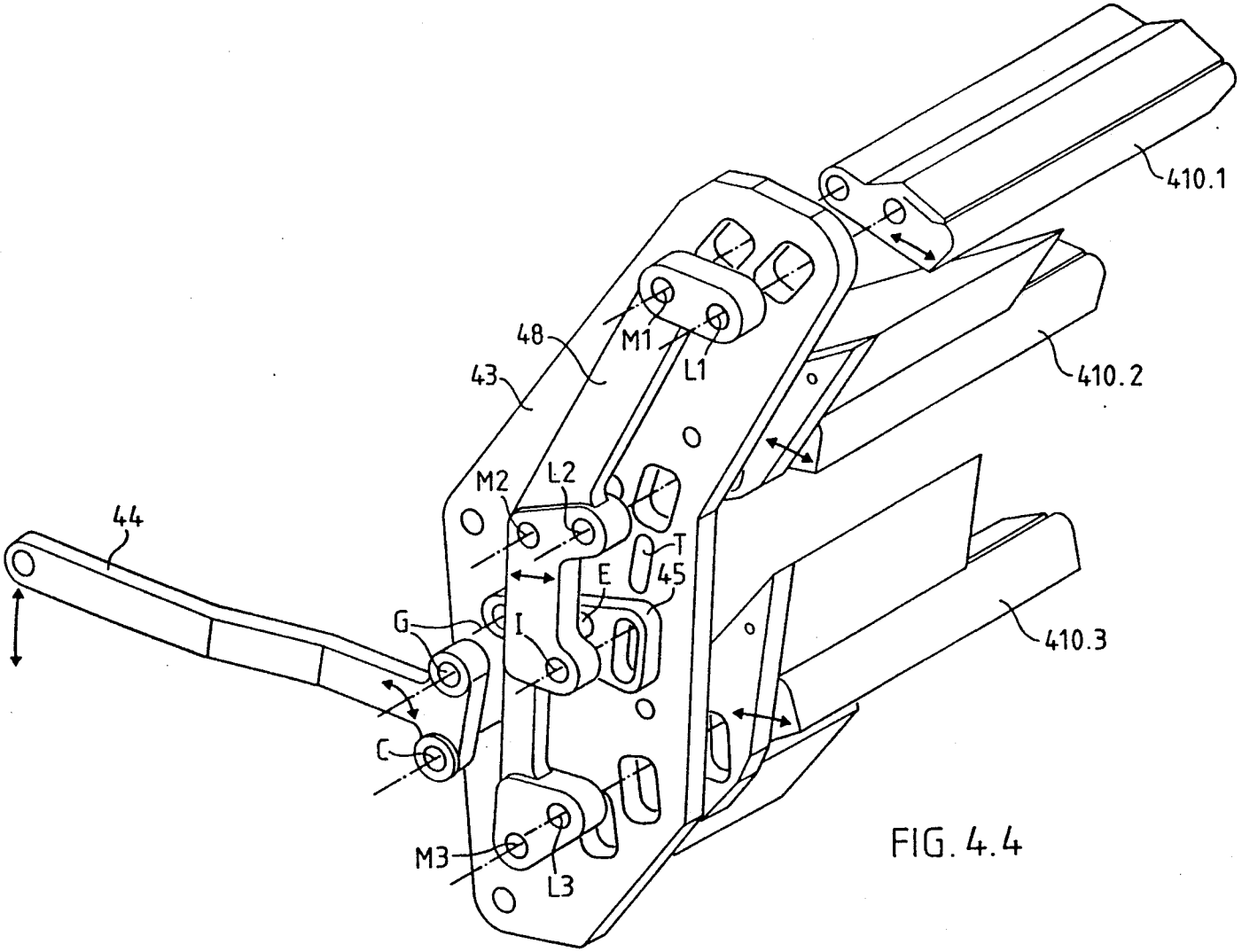
FIG. 4.4

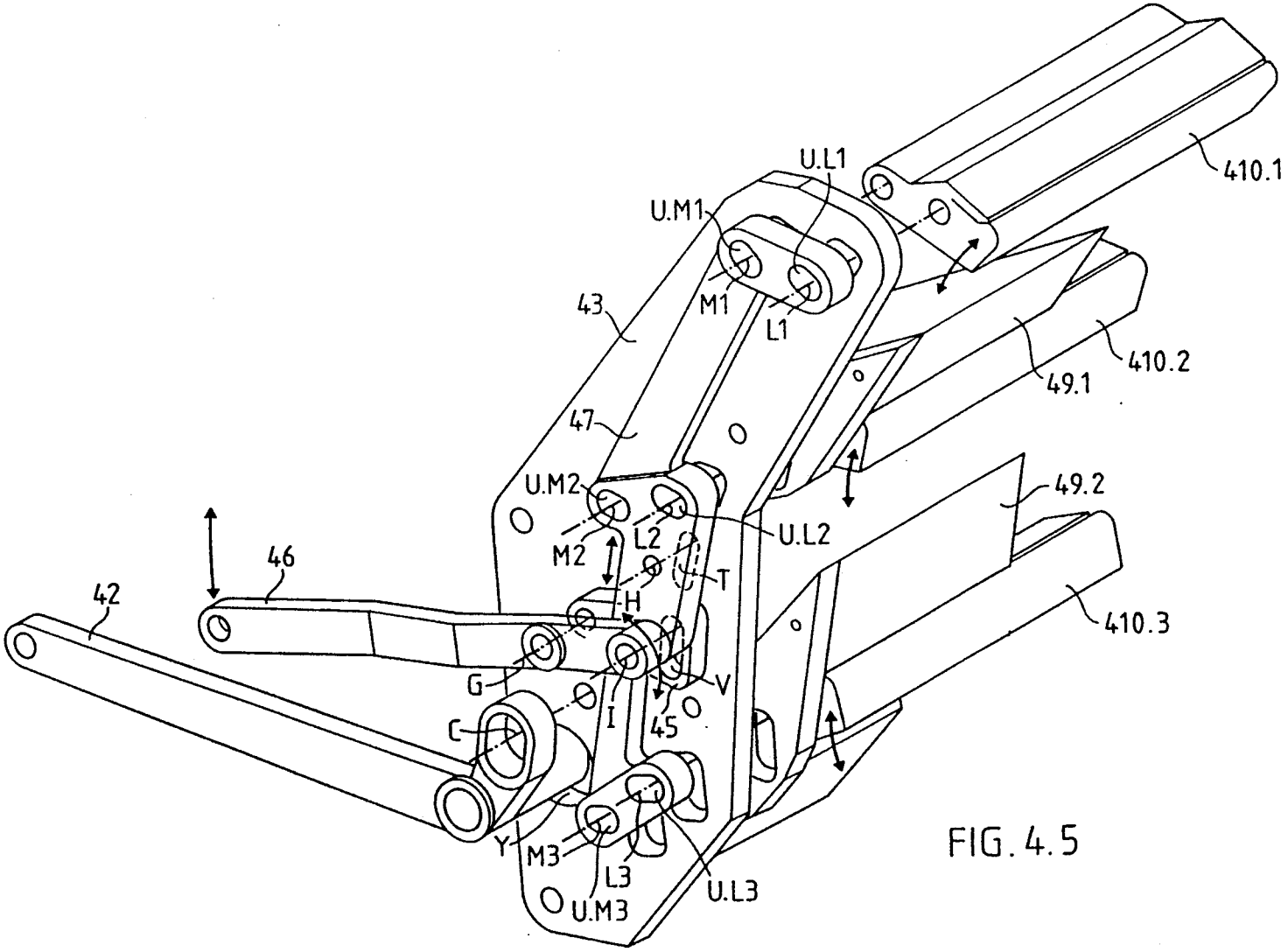
FIG. 4.5

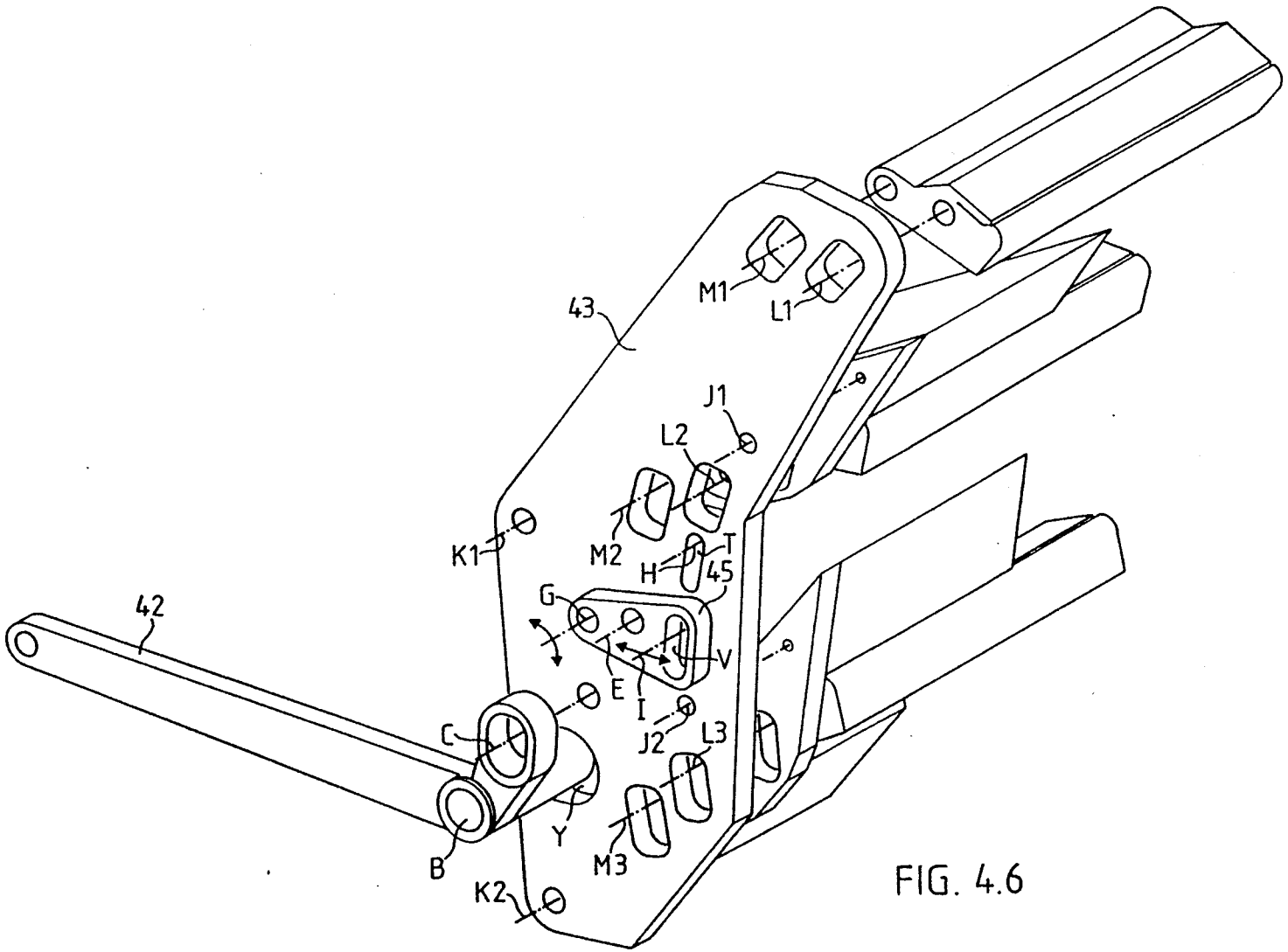
FIG. 4.6

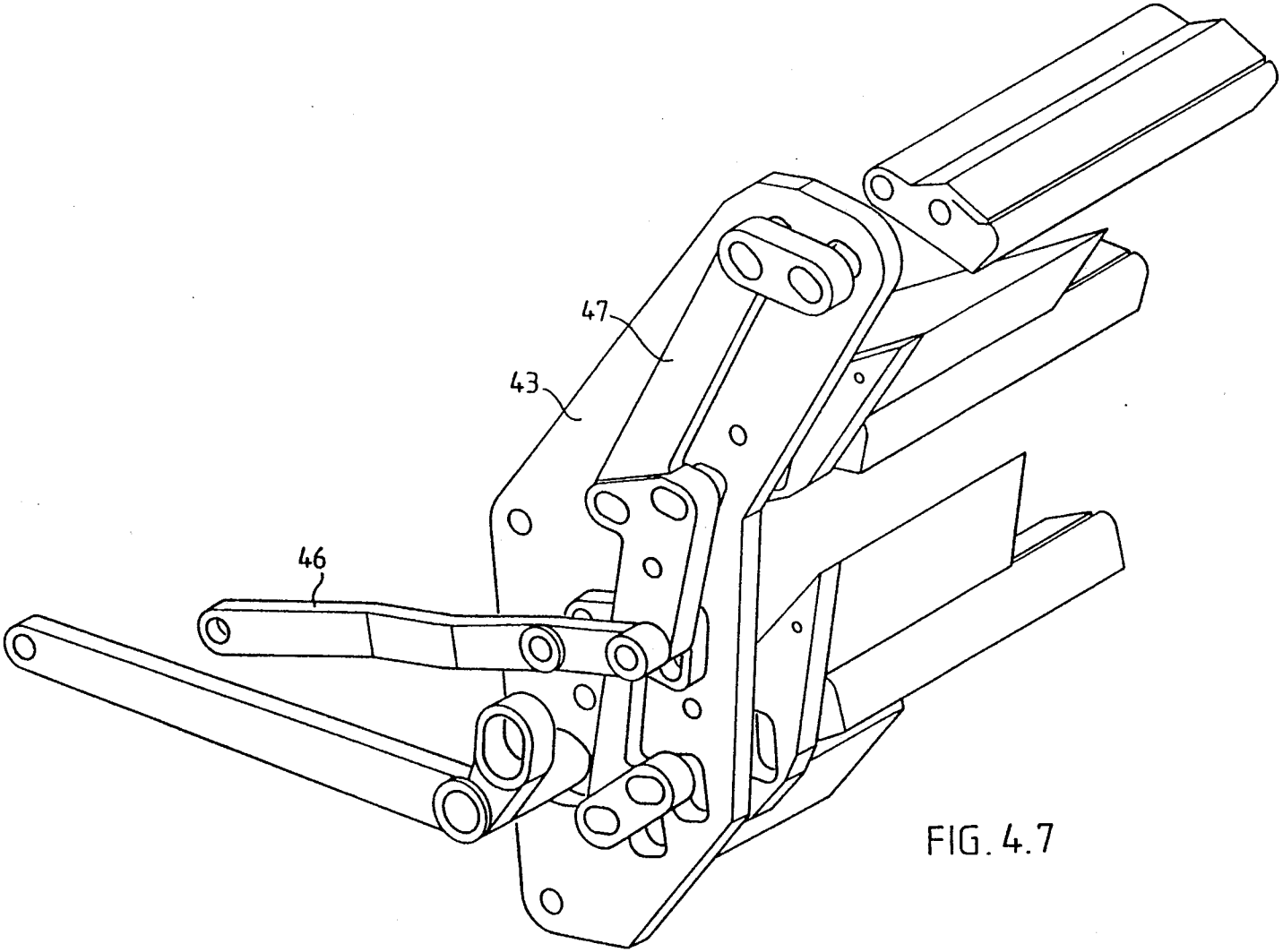
FIG. 4.7

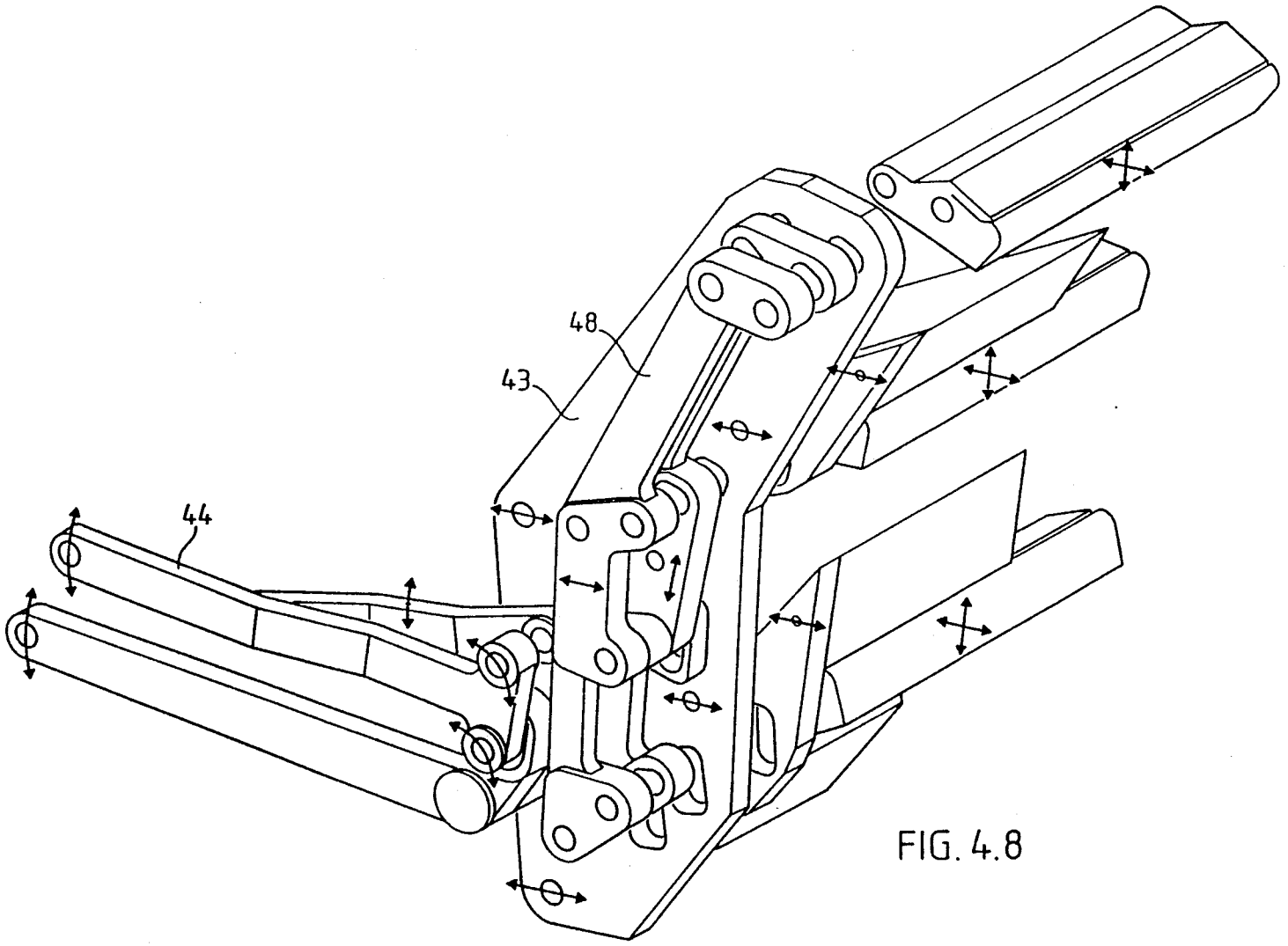
FIG. 4.8

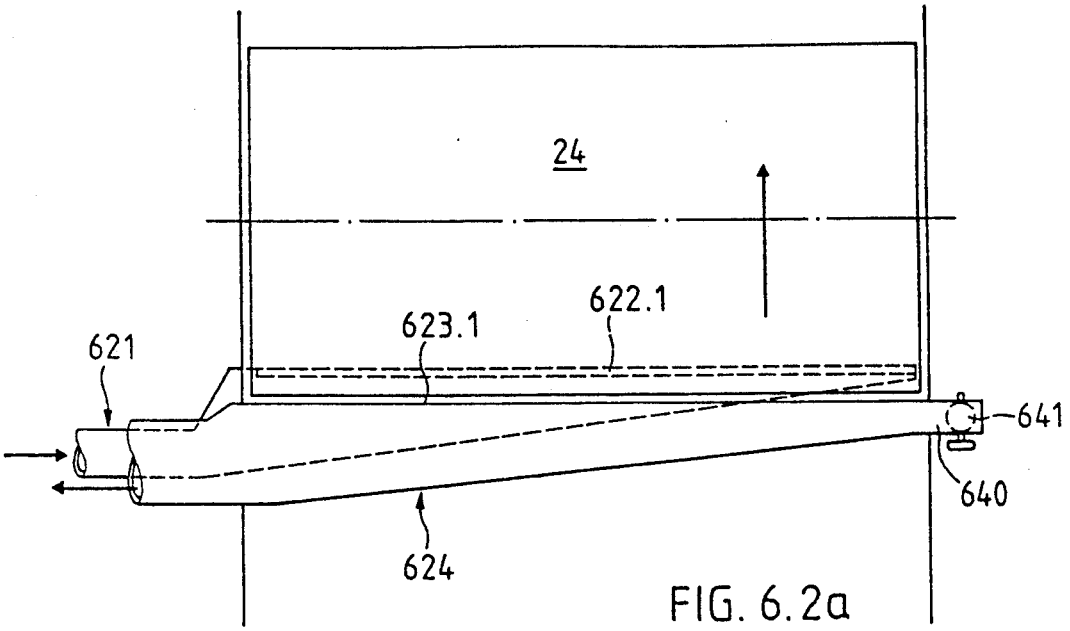
FIG. 6.2a
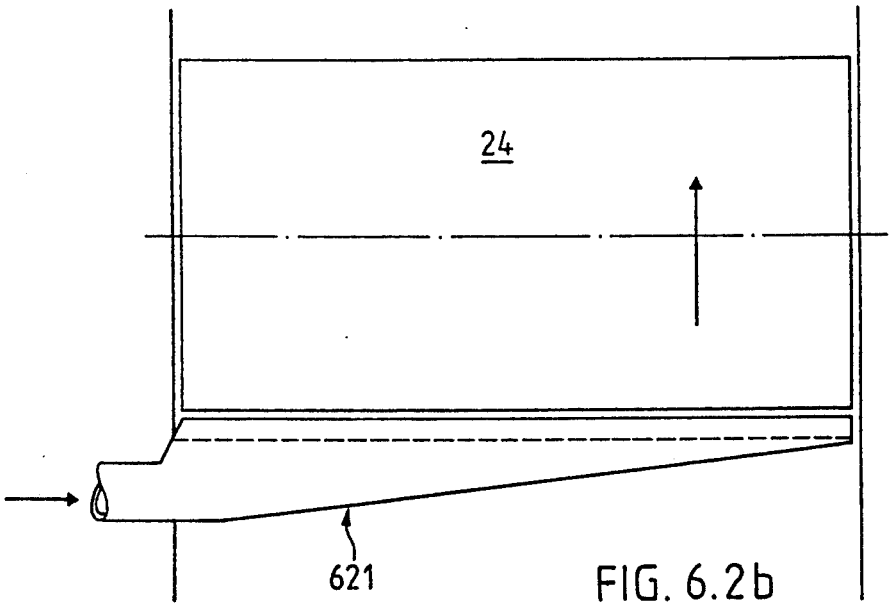
FIG. 6.2b

FIG 6.3

METHOD AND APPARATUS FOR THE FINE CLEANING OF TEXTILE FIBERS

BACKGROUND OF THE INVENTION

1. Field of the Invention

The present invention relates to the field of spinning machines and more particularly, the invention relates to the fine cleaning of textile fibers and to a method of fine cleaning of textile fibers and an apparatus for performing the method.

2. Description of the Related Art

Textile fibers, especially cotton fibers, are subjected to coarse cleaning after the bales have been opened, during which the coarse contaminants are removed. The fine cleaning follows after the coarse cleaning, during which all of the particles of dirt remaining in the fibers after the coarse cleaning are to be removed to the greatest extent possible. The fibers then go to the next spinning preparatory step after undergoing the fine cleaning operation, such as to the carding machine, for example.

The fine cleaning must be so arranged that all of the contaminants contained in the fibers from every origin must be removed, to the greatest extent possible, without any detrimental effect on the quality of the fibers and without separating, in conjunction with the contaminants, a larger proportion of the fibers.

Fibers from various origins differ in the following characteristics:

Fiber length: The fiber length should not be influenced during the cleaning.

Fiber strength: The fiber strength should not be influenced during the cleaning. The greater the fiber strength, the greater can be the aggressiveness of the cleaning without damage resulting to the fibers.

Fiber parallelism: The more the individual fibers lie parallel to each other, the more uniform are the spaces between the fibers and the less difficult is the separation of the fibers from each other.

Degree of contamination: Particles of contamination lie between the fibers. The degree of contamination is determined by the number and type of the contamination particles.

Type of contamination particles: The contamination particles can be compared with the size of the space in the flocks, small or large; the contamination particles can be compared with the weight of the fibers, heavy or light, and the light contamination particles can be trapped in the spaces of the flocks, either adhering to or loosely contained within the flocks or fibers.

Heretofore, the fine cleaning of textile fibers has been undertaken with fine cleaning machines in which the flocks from the coarse cleaning were somewhat precleaned in a screen or sieve during the operation and compressed into a bat. The bat is then carried further by a feed roller, trapped by a synchronized system by the teeth of the central opening roller and carried with the opening roller for a part of one revolution. During this revolution, the bat is carried past guiding elements and separation blades, alternately. After this cleaning, the bat is withdrawn by suction from the opening roller.

Even though, on such machines, input quantity, air speeds and the rotational speed of the opening roller are altered, and the arrangement of the guide elements and separating blades can be set mechanically, nevertheless, they are not sufficiently versatile, i.e., not sufficiently flexible or adjustable to provide a real guarantee of optimum cleaning in every case. In addition, it is very troublesome and costly to change the fine setting of the machine to adapt the cleaning process for accommodation of fibers having a different origin. Particularly, the fine setting of the cleaning process is not possible during the dynamic operation of the cleaning machine.

SUMMARY OF THE INVENTION

It is therefore an object of the invention to provide a method for the fine cleaning of textile fibers and to provide an apparatus with which a broad spectrum of fiber origins, i.e , fibers having different qualities and different degrees of contamination, can be cleaned in such a way that intensive cleaning can take place, that the cleaning degree and the detriment to the fibers, are optimally accommodated to the carded sliver or yarn. In addition, the range of setting possibilities of the relevant machine parameters for the cleaning operation is large and the adjustments of the parameters from one fiber origin to the other are rapid and with low cost and are undertaken, as far as possible, during the process sequence. In other words, it is possible to set the cleaning parameters externally, or remotely, without manual intervention in the machine. Entry in the fine cleaning machine and the suction withdrawal of the cleaned fibers and dirt are so arranged that the cleaning process is at no time impeded during the cleaning operation.

It is, more specifically, an object of the invention to provide a method of cleaning textile fibers in a cleaning machine having a fiber bat feeding device and a rotating opening roller for conveying the fiber bat in a transport direction, the method including the steps of:

- conveying the textile fibers from an inlet to a clamping point proximate the opening roller;
- compressing and clamping the textile fibers, in the form of a fiber bat, with a clamping force, the clamping force having a magnitude which is a function of a characteristic of the fiber bat;
- drawing the fiber bat from the clamping point to a takeover point on a periphery of the opening roller, the fiber bat then being subjected to centrifugal force due to rotation of the opening roller;
- conveying the fiber bat, under the influence of the centrifugal force, to a separating blade; and
- separating an area of the fiber bat having contaminants concentrated therein resulting from the centrifugal force and from the drawing of the fiber bat.

According to a particular aspect of the invention, the step of drawing the fiber bat is performed as a function of fiber length and/or fiber strength.

Further in this regard, the clamping point and the takeover point are spaced apart by a predetermined distance, the predetermined distance being set as a function of the fiber length, whereby the fibers are drawn out of the bat in a partially drawn fiber condition.

Still further, the magnitude of the clamping force is set as a function of the strength of the fibers, whereby the fibers are drawn out of the fiber bat in a partially drawn fiber condition.

Further, the magnitude of the clamping force is set as a function of the strength of the fibers, whereby the fibers are drawn out of the fiber bat in a partially drawn fiber condition.

According to an additional aspect of the invention, the cleaning machine includes a compression plate, tapering in a conveying direction of the fiber bat to an outlet of the compression plate, the outlet defining the clamping point, the step of compressing and clamping the fiber bat including clamping the fiber bat at the outlet of the compression plate.

Further in this regard, the magnitude of the clamping force is set as a function of the fiber strength.

The method of the invention further includes the step of moving the clamping point to thereby change the distance by which the clamping point and the takeover point are spaced apart.

In a still further aspect of the invention, the method includes the step of deflecting the fiber bat radially inwardly, with respect to the opening roller, in opposition to the centrifugal force.

Further, the cleaning machine includes at least one adjustable guide element, and the step of deflecting the fiber bat includes adjustably sliding the at least one adjustable guide element in a direction toward the fiber bat.

In a still further aspect of the invention, the step of separating an area of the fiber bat is performed by at least one adjustable separating blade.

More specifically according to the invention, at least two separating blades are provided which are simultaneously adjustable.

According to a further aspect of the invention, the method includes the additional step of carding and redrawing the fiber bat, thereby arranging the fibers of the fiber bat generally parallel to each other. The invention can include a fiber-independent drawing step, whereby the fibers of the fiber bat are arranged in parallel.

More specifically, the step of separating an area of the fiber bat is performed after the fiber-independent drawing step, as a result of which, together with the centrifugal force, the contaminants are caused to move to a radial outward area of the bat.

As a final step of the method of the invention, dust and fiber fragments are separated from the fiber bat.

In a further aspect of the invention, at least two cleaning steps are contemplated, the method further including the step of regrouping fibers of the fiber bat between the two cleaning steps. Preferably, the step of regrouping is performed after the step of carding.

More specifically, the step of regrouping includes a first phase, in which an air current is directed toward the periphery of the opening roller, and a second phase, following the first phase with respect to the transport direction, in which (i) an air current is directed away from the opening roller, and (ii) the fiber bat is mechanically braked on a surface facing away from the opening roller.

Still further, the air current of the first phase of the regrouping step is generated via a slit-shaped nozzle.

In a further aspect of the invention, the step of mechanically braking the fiber bat is performed by means of a braking surface having braking points, and the air current of the second phase of the regrouping step is generated by withdrawing air through perforations in the braking surface, proximate the braking points.

It is an additional object of the invention to provide an apparatus for performing the foregoing method of cleaning textile fibers for use in conjunction with an opening roller to which the textile fibers are fed and around which the textile fibers are conveyed, in the form of a fiber bat, in a transport direction, the apparatus including:

means for feeding the textile fibers to the opening roller;

means for clamping the fiber bat with a certain magnitude of clamping force at a clamping point at a certain location in relation to the opening roller;

means for adjusting the location of the clamping point in relation to the opening roller;

means for drawing the fiber bat from the clamping point to a takeover point on a periphery of the opening roller, the fiber bat then being subjected to centrifugal force due to rotation of the opening roller; and means for separating an area of the fiber bat having contaminants concentrated therein resulting from the centrifugal force and from the drawing of the fiber bat.

In a particular aspect of the apparatus of the invention, the means for clamping includes a feed plate and a feed roller, the feed plate having an outlet portion, the bat to be fed between the feed roller and the outlet portion of the feed plate, thereby defining the clamping point Further, the means for clamping further includes means for adjusting a distance between the feed plate and the feed roller.

Still further, the means for adjusting includes means for enabling the feed plate to pivot about an axis extending parallel to an axis of rotation of the feed roller.

In a specific embodiment of the apparatus of the invention, the means for adjusting further includes means for applying a resilient biasing force to the feed roller in a direction toward the feed plate. Further, means are to be provided for adjusting the resilient biasing force during operation of the apparatus.

In an alternative embodiment, means are provided for applying a resilient biasing force against the feed plate in a direction toward the feed roller, and means for adjusting the resilient biasing force during operation of the apparatus.

In a still further aspect of the invention, the means for separating includes at least two separating blades, the apparatus further including at least two guide elements, at least one of the two guide elements being positioned between the separating blades, the guide elements being adapted to deflect the fiber bat radially inwardly, with respect to the opening roller, in opposition to the centrifugal force, and means for positionally adjusting respective ones of the guide elements with respect to the opening roller. One of the guide elements is positioned in front of the separating blades, in relation to the transport direction.

More specifically, according to the apparatus of the invention, means are additionally provided for adjusting a position of the separating blades radially with respect to the opening roller, the adjusting means including a system of levers.

Still further, means are additionally provided for connecting the means for adjusting the guide elements and the means for adjusting the separating blades for adjustable movement of the guide elements with adjustable movement of the separating blades.

Even further, means are also provided for enabling adjustable radial movement, with respect to the opening roller, of the guide elements independently of movement of the separating blades, the means for enabling adjustable movement of the guide elements including a further system of levers.

Further still, means are additionally provided for adjusting a distance between respective guide elements and separating blades.

According to another aspect of the invention, a carding plate is included, which is adapted to be located subsequent to the means for separating, with respect to the transport direction. In a particular embodiment, the carding plate is formed as a separating blade.

According to a specific feature of the invention, means are provided for radially positionally adjusting the carding plate, with respect to the opening roller.

More specifically, means are additionally provided for pivotally mounting the carding plate for enabling variation in a gap adapted to be created between the carding plate and the opening roller, between a convergent gap of a predetermined amount and a divergent gap of a predetermined amount, with respect to the transport direction.

Further according to the apparatus of the invention, a regrouping point is provided subsequent to the carding plate, with respect to the transport direction.

In a specific form of the apparatus of the invention, the regrouping point includes a slit-shaped nozzle and a braking surface proximate thereto.

More specifically, an air channel is positioned for communication with the slit-shaped nozzle for directing an air current toward the opening roller.

In a particular embodiment of the invention, the braking surface includes perforations, and an air extraction conduit is provided which communicates with the perforations.

According to another specific embodiment of the apparatus of the invention, a further arrangement of separating blades and guide elements is provided as a final means for fiber separation, with respect to the transport direction.

It is also envisioned to include a means for discharging fiber waste, including a sluice wheel, means for constantly driving the sluice wheel about an axis of rotation, and means for periodically creating an air current for extracting the waste from an area proximate the sluice wheel in a direction generally perpendicular to the axis of rotation of the sluice wheel.

Still further according to the apparatus of the invention, a further means is provided for cleaning fiber, including an air suction channel for withdrawing air from proximate the opening roller. Further, a fiber bat outlet channel is provided, the air suction channel being in communication with the fiber bat outlet channel.

In a further specific embodiment of the apparatus of the invention, the means for feeding textile fibers includes a screening drum mounted proximate a fiber inlet conduit, the apparatus including a further means for cleaning fiber including a screen and means for enabling an air current directed through the screen and through a sector of the screening drum.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 2*a* illustrates the subject matter of FIG. 2 in greater detail;

FIG. 3.1 is a detail drawing of the takeover point, and the device for performing cleaning step 2, and represents a specific embodiment without an adjustable clamping force;

FIG. 3.2 is a detail drawing of the takeover point, and the device for performing cleaning step 2, and represents a specific embodiment with an adjustable clamping force;

FIG. 3 3 is a further embodiment of the takeover point, and the device for performing cleaning step 2, with an adjustable clamping force;

FIG. 4.1 is a detail drawing of the group of three guide elements and two separating knives, i.e., the device for performing cleaning steps 3 and 6;

FIG. 4.2 is similar to FIG. 4.1 but is a view taken in a direction which is vertical or perpendicular to the axis of rotation;

FIG. 4 3 is a partial device for setting the spacing between the complete device and the beater circle;

FIG. 4.4 is a partial device for the setting of the spacing between the guide elements and the beater circle;

FIG. 4.5 is a partial device for the setting of the spacing between the guide elements and the separating blades;

FIGS. 4.6, 4.7 and 4.8 show the gradual build-up of the device for setting cleaning steps 3 and 6;

FIGS. 6.1*a* and 6.1*b* are detail drawings of the regrouping point, and the device for performing cleaning step 5, in two embodiments;

FIGS. 6.2*a* and 6.2*b* are plan views, taken vertical or perpendicular to the axis of the opening roller, at the regrouping point according to FIG. 6 1;

FIG. 6 3 is a plan view of an embodiment of the regrouping point, taken parallel to the axis of the opening roller;

DETAILED DESCRIPTION OF PREFERRED EMBODIMENTS

Figures 1, 2, 3, 4, 5, 6, 7:
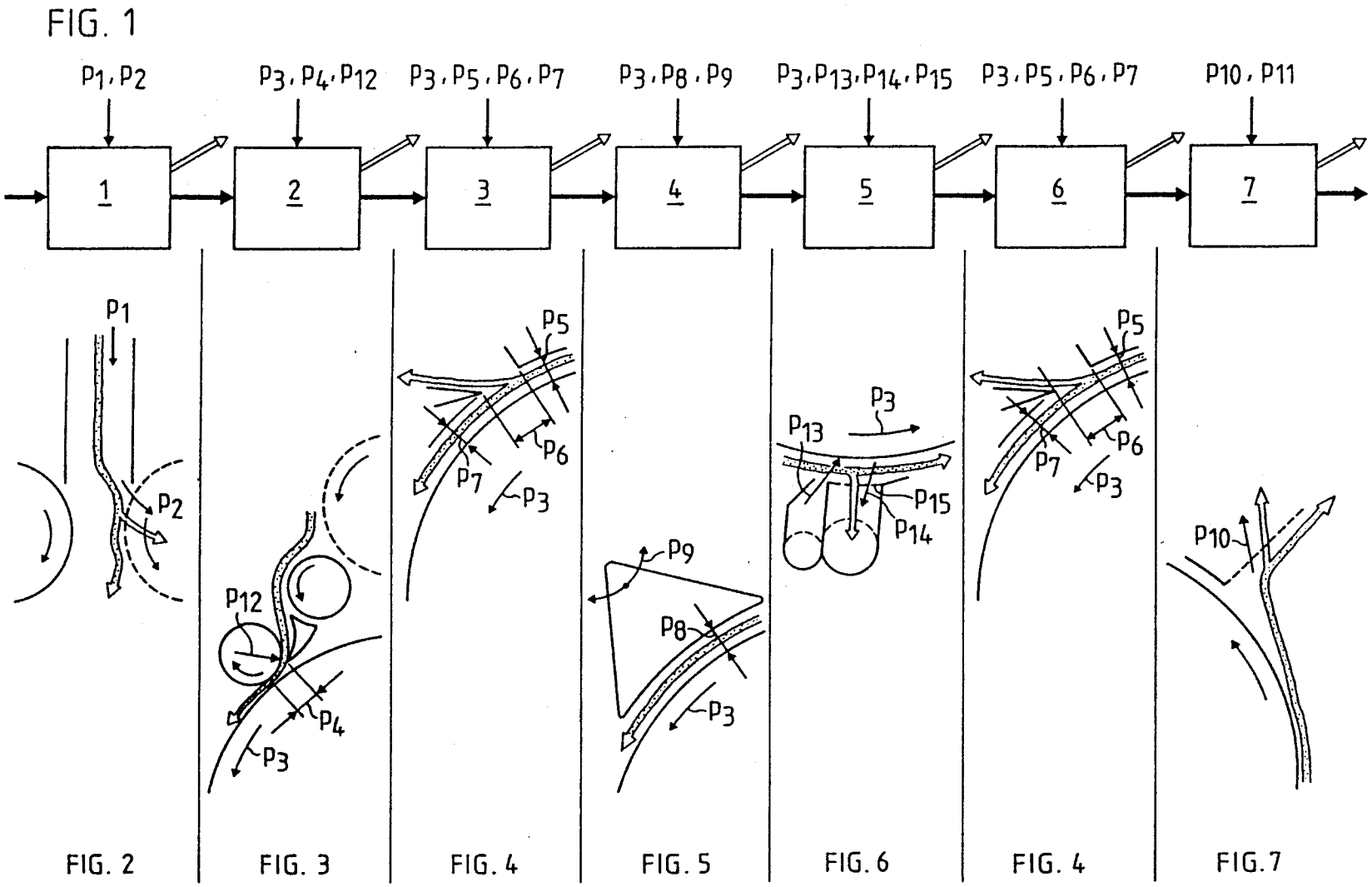
FIG. 1 is a schematic representation of the fine cleaning method according to the invention, illustrating cleaning steps 1 to 7.
FIG. 2 illustrates the entry of the fiber to be cleaned, and the device for performing cleaning step 1.
FIG. 3 illustrates the takeover point, and the device for performing cleaning step 2.
FIG. 4 illustrates the device for performing cleaning steps 3 and 6.
FIG. 5 illustrates the carding plate, i.e., the device for performing cleaning step 4.
FIG. 6 illustrates the regrouping point, and the device for performing cleaning step 5.
FIG. 7 illustrates the outlet and the device for performing cleaning step 7.

FIG. 1 is a schematic diagram of the fine cleaning method of an exemplary embodiment of the invention, with the individual method steps and schematic figures arranged beneath those parts of the fine cleaning apparatus in which the method steps take place. The sequential cleaning steps will initially be described below and, thereafter, the various arrangements and relationships of parts will be described in greater detail with regard to subsequent figures of the drawing.

The fibers pass through all of the cleaning steps and a cleaning operation takes place in every step. In the process diagram of FIG. 1, the fiber stream is indicated with shaded arrows. It either consists of opening or detaching fibers from fibers, or effectively separating contamination particles from the fibers. In other words, the cleaning steps are either opening steps (opening the tangles of fibers), out of which no contamination particles are removed, or they are separating steps, out of which various contamination particles are removed according to the separating method, indicated with unshaded arrows in FIG. 1.

It has been shown to be advantageous when the fiber stream runs through at least one regrouping between cleaning steps. Regrouping refers to a step in which the fibers from the transporting teeth of the opening roller are opened, regrouped and caught again by the transporting teeth. A regrouping step can also be a separating step.

In every method step, the effectiveness of the cleaning is determined by a number of cleaning parameters $p_x$, which are indicated with single-headed arrows in the method diagram of FIG. 1, and in the schematic drawings of the process steps, illustrated in subsequent figures.

The optimal setting of every cleaning parameter $p_x$ is, on the one hand, determined by the characteristics of the fiber origin which is being processed and, on the other hand, through the setting of another sequence of parameters $p_x$ in the other cleaning steps which are a part of the operation. The optimal cleaning of the fibers from a certain origin or a blend of origins is achieved through a set of appropriate cleaning parameters $p_x$ exactly determined, one with respect to the other, for such origin or blend of origins.

The cleaning parameters $p_x$ are set or adjusted according to the characteristics of the fiber origin. The coarsely oriented initial setting is finely optimized through a control setting during the starting period according to the attributes of the fibers and contamination proportions which are present during this period and emanating from the machine.

The initial setting corresponding to fiber origin and the optimization, set immediately following, ensures that the starting loss (i.e., portions of fiber not cleaned optimally from the starting phase) is minimal.

The fine cleaning process can only operate optimally when it is not subjected to any aerodynamic disturbances. It is particularly advantageous when the method is used for the discharge of the contaminants from the fine cleaning machine in which the withdrawal of the contaminants is separated from the fine cleaning machine by suction so that no infiltrated air, or undesired airflow can disturb the cleaning

Cleaning step 1 (Screening, Compressing and Separating Step)

In the fine cleaning machine, flocks are normally fed from the coarse cleaning machine. In cleaning step 1, which is at the same time the inlet of the cleaning machine, the flocks are sucked onto a screen with a current of air. Small, loose contamination particles pass through the screen with the air, while the fibers are retained by the screen and compressed to a fiber bat or wadding, which forms a loose association of single flocks. This bat moves continuously from the inlet to the next cleaning step.

The cleaning parameters of the inlet are:

$p_1$, which represents the quantity of fibers fed in; and $p_2$, which represents the air throughput through the screen or separating element.

The quantity of fibers fed in, $p_1$, determines the performance of the fine cleaning machine. All of the cleaning parameters following the parameter $p_1$ are to be set so that optimal cleaning is still possible with a maximum of fibers fed in. The highest possible quantity of fibers fed in, $p_1$, is determined, among other things, as a function of the degree of contamination of the fibers, through the predetermined production, and through the detriment to the fibers.

The air throughput through the separating element, $p_2$, determines the compactness of the bat formed on the screen. This compactness has the effect on the detriment to the fibers with the plucking in the following cleaning step 2, of creating a more compact bat, the fibers holding together to a greater degree and, thus, a higher resistance is presented in opposition to the drafting operation. At the same time, 1 the air throughput through the separating element, $p_2$, determines the performance and the effect of the cleaning on the screen. The air throughput through the separating element, $p_2$, should not exceed the value at which the fibers start to be carried along through the screen with the contamination particles.

Cleaning Step 2 (Preliminary Drafting Through Plucking, Opening Step)

The bat which emanates from cleaning step 1 is conveyed to the converging slot, at the end of which it is clamped, thereby defining a clamping point. After this clamping, at the so-called takeover point, it is caught by the teeth of the opening roller. As the teeth of the opening roller have a higher speed than the bat that is fed, the bat is plucked apart or drawn by the teeth at the takeover point. This plucking operation effects an increase in the opening of the bat and creates a partial parallelism of the fibers. Through this operation, loose, adhering and trapped contamination particles are only partially conveyed on the surface of the pre-drawn or pre-drafted bat. The pre-drawn bat is conveyed on the teeth of the opening rollers to cleaning step 3.

The cleaning parameters of cleaning step 2 are $p_3$, which represents the speed of the opening roller;

$p_4$, which represents the spacing between the clamping point and the takeover point; and $p_{12}$, which represents the clamping force.

The speed $p_3$ of the central opening roller is the most on cleaning steps 2 to 6. Upon the takeover of the bat through the teeth of the opening roller (cleaning step 2), this parameter determines, together with the quantity fed in, $p_1$, the thickness of the pre-drawn bat. In the following cleaning steps, speed $p_3$ determines the centrifugal force which is utilized as the cleaning force. The greater the speed of the opening roller, then the thinner is the predrawn bat and the less of a problem encountered to clean it in the following cleaning steps. This has, however, its limits and, particularly, as a result, when the speed is too high the fiber is detrimentally affected.

The spacing $p_4$ between the clamping point and the takeover point and the clamping force, $p_{12}$, determines how intensively the fibers are opened and also how detrimentally the fibers are affected through this. If the takeover point and the clamping point are too close to each other (or if the spacing $p_4$ between the takeover point and the clamping point is smaller than the mean staple length), then during plucking of the bat, too large a proportion of the bat must be drawn through the clamping point. If the clamping force, $p_{12}$, is high, then the fibers are laid more in parallel with the plucking and adhesive particles of dirt being better removed from the fibers, but the tension loading of the fibers is correspondingly higher.

As with the plucking operation, contamination particles are also loosened and conveyed to the flock surface, so that a high opening value is desirable. The spacing $p_4$ between the clamping point and the takeover point, and the clamping force, $p_{12}$, should also be set depending upon the staple length and on the strength of the fibers, so that the opening of the fibers is as high as possible, but the fibers must withstand the stress with as little detriment to the quality of the fibers as possible. The longer the fibers and the less the fiber strength, then the further apart the clamping point and the takeover point must lie, that is, then the greater $p_4$ must be, and the smaller the clamping force $p_{12}$ must be.

The more the fibers are dirty, then the greater is the importance of achieving a fiber opening in the pre-drawn bat in the cleaning step 2, which is as high as possible.

Cleaning Step 3 (Centrifuging, Separating Step)

The teeth of the opening roller convey the pre-drawn bat up to and through the cleaning step 3. It is thereby centrifuged, that is, it is stretched radially and, in particular, large, heavy contamination particles are moved radially outwardly. During this centrifuging operation, the bat is deflected, in opposition to the centrifugal force, inwardly through means, such as guide elements, which limit its stretching, or radial expansion. This deflection effects an additional concentration of contamination particles on the outer surface layer of the bat.

This section of the process with radial limitation is followed by a section without radial limitation, on which the loose contamination particles which are trapped and adhering to the upper surface of the bat, can be moved outwardly. Subsequently, a separating blade follows in the transport direction, under which the bat is guided in such a way that the contamination particles are separated.

The sequence of inward deflection, separation over a section without radial limitation and effective separation on the separating blade is repeated two to three times within the cleaning step.

The cleaning parameters of this cleaning step are:

$p_5$, which represents the intensity of the inward deflection (radial position of the guide elements);

$p_6$, which represents the length of the section without radial limitation (spacing between each guide element and the following separating blade); and $p_7$, which represents the radial position of the separating blade.

The intensity $p_5$ of the inward deflection determines the concentration (in addition to the centrifugal force) of the contamination particles on the surface of the bat. It also determines the degree of radial compression of the bat. Since the contamination particles are more difficult to separate from a highly compressed bat, the inward deflection must only be intense or considerable when, at the same time, it is ensured that the bat, before the separation on the separating blade, has sufficient time to expand again radially through a long section without radial limitation $p_6$, as further mentioned below. The value of $p_5$ can be so selected that it is high enough according to the density of the bat emanating from cleaning step 2.

The length $p_6$ of the section without radial limitation determines how vigorously the bat and the contamination particles are separated from each other. It is advantageous for the separation on the separating blade which follows when the previous separation is as large as possible. However, since fibers are separated from the flocks with a large separation of trapped and adhering contamination particles, a separation which is too large should be avoided. An optimal setting of the length of the section has the effect that loose contamination particles separate themselves completely from the flocks. On the other hand, adhering and trapped particles are driven directly to the surface of the flocks. This optimal setting depends particularly on the thickness and compressibility of the bat. The thinner and less compressed the bat is, then the shorter the section should be.

The radial position $p_7$ of the separating blade determines the point at which the contamination portion should be separated from the bat with an optimal setting. The separating blade moves exactly over the bat surface so that the contamination particles already free are separated purely spatially, i.e., by gravity and/or by centrifugal force, and the contamination particles adhering or trapped are separated by mechanical means. If the blade position is too high, then too few contamination particles are separated. If it is too low, then too many fibers are torn out of the flocks and are removed together with the contamination particles. The optimal setting of the radial position of the separating blade depends upon the bat guided under the blade. It is, above all, to be correlated with the other cleaning parameters $p_5$ and $p_6$ of this cleaning step.

Cleaning Step 4 (Parallelism Through Cards, Opening Step)

In cleaning step 4, the pre-drawn and centrifuged bat is drawn by the teeth of the opening roller under a carding plate. Thereby, the fibers are substantially arranged in parallel and forced against each other at the same time. Through the parallel arrangement of the fibers, trapped contamination particles are released, and also adhering particles are released from the fibers by the frictional contact of the fibers. The flocks are conveyed to the next cleaning step together with the contamination particles.

The cleaning parameters of the carding step are:

$p_8$, which represents the penetration depth of the card clothing (e.g., needles or teeth) into the bat, or fiber layer; and $p_9$, which represents the gradient of the carding intensity.

The penetration depth $p_8$ of the card clothing must, first of all, depend upon the thickness of the bat conveyed to the carding step. That is, it is dependent, first of all, on the cleaning parameters $p_3$, $p_5$, $p_6$ and $p_7$ of the cleaning step 3. Apart from the foregoing, the penetration depth $p_8$ of the card clothing in the bat determines the degree of parallelism achieved and, with this, the degree of the separation between the fibers and the contamination particles. The deeper the clothing penetrates, then the higher is the degree of parallelism and the degree of cleaning, but then the higher is the detriment to the fibers.

The optimal setting of the parameter $p_8$ also depends therewith upon the characteristics of the fiber origin, on the speed $p_3$ of the opening roller, and upon the parallelism of the fibers obtained at the time. The longer the fibers are, then the smaller the fiber strength, the greater the speed of the opening roller, and the less the parallelism of the fibers at the inlet to the carding step, then the less intensively can carding be accomplished, with the fibers undergoing excessive detriment, and therefore, the larger must be the spacing between carding plate and opening roller.

The degree of parallelism and the extent of opening which can be achieved in this step can still be improved when the penetration depth of the card clothing is increased with progressive carding. The intensity $p_9$ of the carding is continually so much increased that, with an increasing degree of parallelism, the carding operation is always run with the highest acceptable detriment to the fibers. The optimal setting of the gradients of the carding intensity depends upon the same parameters as the setting of the penetration depth $p_8$ of the card clothing.

Cleaning Step 5 (Opening and Separating Step)

From the takeover point, where the fiber bat is taken from the teeth of the opening roller, the bat is moved through the individual cleaning steps by the movement of these teeth as described. Thereby, the degree of parallelism and the degree of contamination of the fiber material is altered, as described, and particularly, in the areas of the bat furthest from the surface of the opening roller and between the teeth. Near to the surface of the opening roller, i.e., where the teeth move the fiber material, the alteration is less, as the fibers are pressed together through pulling against the teeth.

It has been determined that the cleaning effect of the cleaning process is improved when a regrouping step is added in which the arrangement of the fibers is altered, especially in the area of the bat proximate the transporting teeth. This is achieved through aerodynamic forces, which move the bat against the teeth in a narrow place and then remove it immediately afterwards, while it is braked on the opposite side.

Through this operation, the connections between the bat and the teeth are loosened and individual parts of the bat, which have just been braked, are overtaken by other portions of the bat, so that a general regrouping takes place. Directly after the regrouping, it must be arranged with the aid of the guide plate that the fibers, which are only partly held by the teeth of the opening roller through the regrouping, must be driven against the teeth again and are not forced apart by the centrifugal force of the opening roller. The aerodynamic forces are produced through the appropriate blowing and suction of air, the braking effect being produced through mechanical braking on a braking surface. If more air is withdrawn than is blown in, then particles of dirt can be sucked out during the regrouping, so that the regrouping step represents a separating step at the same time.

The cleaning parameters of the regrouping step are:

$p_{13}$, which represents the aerodynamic force directed against the opening roller;

$p_{14}$, which represents the aerodynamic force directed away from the opening roller;

$p_{15}$, which represents the braking effect.

The three cleaning parameters $p_{13}$, $p_{14}$, and $p_{15}$ must be concerted such that the improvement of the cleaning effect is the largest possible on the cleaning steps following the regrouping step, but the parallelism of the fibers, hitherto achieved, is only lost to a tolerable degree.

Cleaning Step 6 (Centrifuging, Separating Step)

Cleaning step 6 corresponds exactly to cleaning step 3 in its cleaning function and in its cleaning parameters. The cleaning parameters should be so set in this cleaning step that the cleaning is slightly more aggressive than in cleaning step 3, because it is important to separate the heavy contamination particles, even if some fibers are carried away with them. Heavy contamination particles which are not separated in this cleaning step will remain with the fibers.

Cleaning Step 7 (Screening, Separating Step)

In cleaning step 7, the bat is moved past a further separating device by means of which fiber dust, which may have built up during the fiber processing, is removed. The separating device can be a grating, a screen, or a slotted plate which can be advantageously subjected to small amplitude vibrations. This movement from the position of rest can be produced directly, or can be the result of membrane vibrations caused by air carried across the plate. In the present example, the fiber material is sucked briefly onto a screen, by which it is held back, while small, loose contamination particles, in particular, can penetrate through the screen. The vibrating support effects a loosening of the fiber layer, which is briefly exposed to a suction force and transported in the conveying direction, before the fibers are, again, briefly exposed to the suction force. In this way, the long fibers are separated from dust and possible fiber fragments.

The cleaning parameters for this cleaning step are:

$p_{10}$, which represents the air throughput through the separating element; and $p_{11}$, which represents the vibration (amplitude and frequency).

As in cleaning step 1, the air throughput through the separating element is also optimally set in this case, when as much dust and dirt as possible are sucked out, but only as few fibers as possible. The transporting effect through the "membrane vibration" by means of an air current is generally sufficient, so that, in most cases, forced mechanical vibration is unnecessary. However, if a device of this type is present, it is driven with the parameter $p_{11}$ which is set in such a way that the transport of the fiber material along the outlet port is adequate.

The various arrangements and relationships of parts for performing the foregoing fiber cleaning steps will now be described in greater detail.

FIG. 2*a* shows a particular embodiment of the device for performing cleaning step 1. The inlet consists of a channel 21, through which the external air and feed flocks are withdrawn by suction. The material flow W is supported through the rotation of a dummy drum 22 and the rotation of a screening drum 23. The air is withdrawn by suction through the screening drum 23. The bat accumulation on the screening drum 23 moves with the screening surface and is moved from there to cleaning step 2.

The speed of the air current $p_2$ is set according to the suction performance.

Variations of the embodiments described above are contemplated. For example:

dummy drum 22 can be omitted from the inlet;

the function of the screening drum 23 can, instead, be achieved by means of a stationary screen;

the air is only withdrawn through a limited sector of the screening drum 23; and air can be blown against the bat through the sector of the screening drum from which the bat is loosened, in order to facilitate the separation.

FIG. 3.1 illustrates an embodiment of the device for performing cleaning step 2, which is a variant with adjustable clearance $p_4$ between the clamping point and the takeover point, but not with adjustable clamping force. The bat W separated from the screening drum 23 of the inlet is conveyed from a doffer roll 31 and, from there, from a feed roller 32 into the converging slot between the feed roller 32 and a feed trough 34. The position between the feed roller 32 and the outlet edge 33 of the feed trough 34, that is, the narrowest point of the clamping slot, is known as the clamping position.

The toothed feed roller 32 also conveys the bat through the clamping slot to the takeover position on the opening roller 24, that is, to the place where the bat is taken over by the teeth 24.1 of the opening roller 24, and is further conveyed in the form of pre-drawn bat. The direction of rotation of the feed roller 32 and opening roller 24 are such that the bat does not alter its direction through the takeover by the opening roller 24, which is referred to as a synchronous feeding (if the direction of rotation of the opening roller 24 were effected in the opposite direction, one would speak of a constant feeding arrangement of a counter-rotating feed.)

The feed trough 34 is movable in relation to the feed roller 32 in that it swivels in a guide around the axis of the feed roller 32, when the feed roller 32 is set in its normal working position or in its position of rest to the feed trough. The guide is more clearly explained below with respect to FIG. 3.2. Through this, the spacing between the clamping position and the takeover point becomes the machine parameter $p_4$, described above, which can be set externally or remotely.

The feed roller 32 is, in its entirety, arranged to pivot around the axis of the opening roller 24, which is itself fixed. Through this arrangement, the spacing between the feed roller 32 and the feed trough 34, also the clamping slot including the clamping position, is adjustable. The pivoting arrangement is effected by pivotally mounting the feed roller 32 upon a swivel arm 36, the swivel arm being pivotally mounted on the axis of opening roller 24. Further, by means of a compression spring 35 and a swivel lever 37, attached to swivel arm 36, the feed roller 32 can be swivelled out of its position of rest, so that the clamping slot can be widened from a minimum width against the spring force. This widening of the clamping slot through the movement of the feed roller 32, on the one hand, serves for the possibility of a slight widening of the slot for the initial introduction of the bat between the feed roller 32 and the feed trough 34 and, on the other hand, it serves to prevent the bat from being torn by the opening roller 24 at the outlet of the clamping slot in case an alteration of the thickness of the bat causes a sudden increase of the clamping force. The clamping force is determined through the spring rate of the spring 35.

Variations of the embodiments described above are contemplated. For example:

the doffer roll 31 can be omitted (particularly in combination with the variant of the inlet, with which the bat on one sector of the screening drum 23 is blown outwardly from the screening drum); and instead of the spring-loaded swivelling of the feed roller 32, a spring-loaded, adjustable connection can be provided between the feed roller 32 and the feed trough 34 (described below with regard to FIG. 3.3).

FIG. 3.2 shows an embodiment of the device for performing cleaning step 2 with an adjustable clearance between the clamping point and the takeover point $p_4$, and an adjustable clamping force $p_{12}$. On swivel lever 37, fastened on swivel arm 36, a spring housing 100 is fastened, which serves for the installation of compression spring 101. In the spring housing 101, a pressure piston 102, which is fastened on the free end of the piston rod 103, projects against the compression spring 101. The piston rod 103 is a component of a pressure cylinder 104, which, in its entirety, can swivel by means of a swivel pin 105 on a stationary support 106. The pressure cylinder 104 is operated via a pressure regulating valve 109 and a pressure conduit 107 which is fed from a fluid pressure source 110.

The pressure regulating valve 109 can be set to a desired pressure in the pressure conduit 107 by means of a pressure regulating element 111 (represented symbolically with an arrow) which can be read by means of a manometer 108 connected to conduit 107. The pressure regulating element 111 can be operated manually by a rotary knob or the pressure regulating valve 109 can be produced in such a way that the pressure regulating or setting element 111 is remotely controlled (not shown) and, if required, automatically set via a control (not shown).

With the help of an arrangement of this type, the pressure spring 101 can be more or less prestressed, whereby the clamping force $p_{12}$ exerted against the fiber bat W on the narrowest part between the feed trough 34 and the feed roller 32 (clamping point) can be determined and set according to the characteristics of the fibers to be cleaned.

The swivelling motion mentioned above in connection with FIG. 3.1 of the feed trough 34, in the embodiment shown in FIG. 3.2 is at least schematically represented with the help of the guide track 112 and the guide pins 113 and 114, in that the guide pins 113 and 114 are fitted to a stationary housing part 116, so that the feed trough 34 can be swivelled around the axis of the feed roller in the framework of the guide track 112 and the position of the guide pins 113 and 114 according to the direction bolt 114, which presses on the feed trough 34, to thereby fix the position of the feed trough.

The stationary housing part 116, as shown with a dashed line, is inserted in a groove of the feed trough 34 in such a way that the feed trough 34 is guided in both directions, vertically, in the plane of FIG. 3.2.

The feed trough 34 is to be manually moved, however, the possibility of a remote control movement is also contemplated.

For the remainder of this embodiment, the parts already described above in connection with FIG. 3.1 have the same reference numerals and require no further explanation.

FIG. 3.3 shows a variation of the embodiment of FIG. 3.2, in that a feed plate 120 (also called a feed trough) is supported to swivel by means of a swivel pin 121 on a carrier 22. The carrier 122 is guided by means of a guide track 123 and guide pins 124 and 125 in such a way that the carrier 122, together with the feed plate 120, swivels on the axis of the feed roller 32 corresponding to the direction of the arrows 39. Thereby, the guide pins 124 and 125 are fitted in a support 127, which is, at the same time, a guide for movement of the carrier 122 in a vertical direction, in the plane of FIG. 3.3. Thereby, it should be noted that an upper and a lower carrier (shown in FIG. 3.3) are present and that is, one above the support 127 and the other underneath (not shown). Thereby, both carriers 122 lie on the appropriate surface of the support 127, so that the carrier 122 with the feed plate 120 is guided in both directions, vertically, in the plane of FIG. 3.3. For fixing the support with regard to the swivelling motion according to the arrow 139, the carrier 122 is fixed by means of a headed fixing bolt 126, which is adjustably threaded into the support 127. The support 127 is a fixed component of stationary machine part 128.

A pressure cylinder 129 is fixed on each carrier 122, the piston rod 130 of which is provided with a pressure piston 131, which presses on a pressure spring 132, which is guided in a spring housing 133, which is fastened on the feed plate 120. The pressure cylinder 129 is under pressure via a pressure regulating valve 136 and a pressure conduit 134, so that the pressure piston 131 can compress the spring 132. The desired pressure for the valve 137, as described analogously for the valve 109 of FIG. 3.2, is set by means of a pressure regulating element 137, which is set to the pressure read by means of a manometer 135. The pressure regulating valve is under pressure from a fluid pressure source 138.

In the variation represented in FIG. 3.3, the axis of the feed roller 32 is arranged to be stationary with respect to the machine housing. In opposition to the arrangement of FIG. 3.2, in which the width of the clamping slot is changed by displacing the feed roller, in FIG. 3.3, the width of the clamping position is set by displacing the feed plate 120 on the swivel pin 121. The type and range of adjustment achieved is the same in both cases. The advantage of the variation according to FIG. 3.3 consists in that only one element, namely the feed plate 120, must be held to swivel in both senses, and the driving shaft of the feed roller 32 can be supported in stationary bearings.

FIGS. 4.1–4.8 illustrate an embodiment of the device for performing cleaning steps 3 and 6 with all their components. This embodiment includes two separating blades and three guide elements. This device is further described in co-pending commonly assigned U.S. application Ser. No. 07/585,707, filed Sep. 20, 1990 now U.S. Pat. No. 5,084,942, the disclosure of which is hereby incorporated by reference in its entirety.

With reference to FIG. 4.1, on the outside periphery of an opening roller 24 having a toothed surface 24.1, the so-called "beater circle" S, the fiber bat to be cleaned is moved in the direction of the heavy arrows through this cleaning step. In the transport direction, the bat which has already been subjected to the centrifugal force before this cleaning step, through which the contamination particles have been concentrated in the outer zone, is at first passed under a guide element 410.1. The guide element 410.1 projects into the transport path and deflects the bat inwardly, that is, against the centrifugal force, and through this action, further increases the radial separation of the bat into contaminants and fibers.

A separating blade 49.1 follows in the transport direction of the fibers. The bat is conveyed under the separating blade 49.1 and is thereby separated into fiber and contamination proportions. A second guide element 410.2 follows the separating blade 49.1, and then a second separating blade 49.2 and a third guide element 410.3 additionally follow.

So that the group of guide elements and separating blades can be set for fibers having different origins, or from different blends of origins, the following dimensions are adjustable:

the spacing $p_7$ between the separating blades 49.1 and 49.2 and the beater circle S;

the spacing $p_5$ between the guide elements 410.1, 410.2 and 410.3 and the beater circle S; and the spacing $p_6$ between one guide element 410.1 or 410.2 and a respective separating blade 49.1 or 49.2.

Three levers 42, 44 and 46 are shown in FIG. 4.1, with the assistance of which the three spacings $p_5$, $p_6$, and $p_7$ can be adjusted through a motorized drive. When the lever 42 is moved about axis B, as shown by dash-dotted lines in FIG. 4.1, the entire device moves away from the beater circle, that is, $p_7$ and $p_5$ are increased to the same extent. The positions of the lever 42 and the separating blades 49.1 and 49.2 shown in FIG. 4.1 represent their nearest respective positions to the beater circle.

When the lever 44 is moved about axis C, as shown in FIG. 4.1 with dash-dotted lines, the guide elements 410.1, 410.2 and 410.3 move away from the beater circle, while the separating blades 49.1 and 49.2 retain their positions, that is, $p_5$ becomes greater while $p_7$ remains the same. The positions of the lever 44 and the guide elements 410.1, 410.21, and 410.3 shown in FIG. 4.1 represent their nearest respective positions to the beater circle with respect to the separating blades.

When the lever 46 is moved about axis G, as shown in FIG. 4.1 with dash-dotted lines, all the guide elements 410.1, 410.2 and 410.3 move in the transport direction of the bat, without any relative radial movement and, further, without any relative radial movement of the separating blades 49.1 and 49.2 relative to the beater circle S. In other words, each of the guide elements 410.1, 410.2 move against the respective separating blades 49.1, 49.2, $p_6$ thereby becoming smaller. In the position shown in FIG. 4.1 of the lever 46, of the guide elements 410.1, 410.2, and 410.3, and of the separating blades 49.1 and 49.2, $p_6$ has the greatest possible value.

Variations of the embodiment of the device according to the invention, as shown in FIG. 4.1, are contemplated. For example:

the first element 410.1 can be omitted:

a third separating blade can follow behind the third guide element 410.3, the separating device thereby consisting of three pairs, each comprising one guide element and one separating blade; and the complete cleaning step can consist of more than three pairs, each comprising one separating blade and one guide element.

FIG. 4.2 illustrates the device for performing cleaning steps 3 and 6, taken in a direction which is perpendicular to the axis of the opening roller 24. It can be seen how the device according to the invention is arranged on the face of the opening roller.

The face of the opening roller is covered by a housing 411. The lever unit for the operation of the setting of the guide elements and separating blades, which is explained in greater detail with the aid of the following figures, is fitted on the side of the housing 411 which faces away from the opening roller. The separating blades 49.1 and 49.2, as well as the guide elements 410.1, 410.2 and 410.3, extend parallel to the axis of the opening roller 24 over their entire length. Neither the separating blades nor the guide elements can be seen in FIG. 4.2. However, the three pairs of pins L1/M1, L2/M2, and L3/M3 can be seen, which make the connection between the lever unit and guide elements 410.1, 10.2, and 410.3. Likewise, the two pairs of pins J1/K1 and J2/K2, which connect the lever unit with the separating blades, 49.1 and 49.2, are also shown.

The pins L1/M1, L2/M2, L3/M3, J1/K1 and J2/K2, as well as B, C, G, I, H, and E, are indicated by dash-dotted lines in the figures.

A lever unit is contemplated to be arranged on the opposite face of the opening roller, which is formed as a mirror image of the lever unit shown in FIG. 4.2.

The lever unit consists of three parts, or partial devices, each for the setting of the cleaning parameters $p_5$, $p_6$, $p_7$. The lever 42 and a plate 43 comprise the partial device for the radial setting of the entire device ($p_7$ and $p_5$ together) on which all the other parts of the device are fitted. In addition to the lever 44, an intermediate lever 45 and a transverse lever 48 comprise the partial device for the setting of the radial position of the guide elements 410.1, 410.2, and 410.3 (i.e., only parameter $p_5$). In addition to the lever 46, a transverse lever 47 comprises the partial device for setting the spacing between the guide elements and the separating blades ($p_6$).

FIG. 4.3 illustrates, in perspective, the partial device for setting the spacing between the entire device and the beater circle S (setting of parameters $p_7$ and $p_5$ together). Certain elements of the lower unit are omitted for facilitating the following description. The pair of pins J1/K1 and J2/K2 which rigidly connect the plate 43 with the separating blades 49.1 and 49.2, extend into the housing 411 in guides Z (see also FIGS. 4.1 and 4.2) and which extend parallel to the radius of the opening roller 24 through the middle of plate 43. Pin C is pivoted on the plate 43 and connects plate 43 the lever 42. When the lever 42 swivels on the pin B on the housing 411, the plate 43 moves in the guides mentioned above. The slippage resulting from such a movement of the pin C takes place against the lever 42 along the slot Q in the lever 42. The two separating blades 49.1 and 49.2 and the guide elements 410.1, 410.2 and 410.3 move with the plate in the radial direction of the opening roller 24.

FIG. 4.4 illustrates the partial device for setting the spacing between the guide elements 410.1, 410.2, and 410.3 and the beater circle S (setting of parameter $p_5$). This spacing is primarily determined through the position of the plate 43 in relation to the beater circle S, as mentioned above, but it can, however, still be increased independently of this position. The guide elements 410.1, 410.2, and 410.3 are connected to the transverse lever 48 through the pairs of pins L1/M1, L2/M2, L3/M3. The transverse lever 48 is connected with the intermediate lever 45 through the pin I. The intermediate lever 45 is pivoted on the lever 44 through the pin G. When the lever 44 is swivelled on the pin C pivoted on the plate 43, the pin G, which has an appropriate guide on the plate 43 (visible in FIG. 4.3) moves and draws the intermediate lever 45 with it, whereby a pin E, which is rigidly connected with the intermediate lever 45, is guided in a radially extending guide R (seen in FIG. 4.3) in the plate 43, and the pin I carries the transverse lever 48 with it. As the transverse lever 48 is connected over the pairs of pins L1/M1, L2/M2, and L3/M3, with the guide elements 410.1, 410.2, and 410.3, these guide elements, neglecting the swivelling movement of the intermediate lever 45, move parallel to the radius of the opening roller 24, which extends through the middle of the plate 43.

FIG. 4.5 illustrates the partial device for the setting of the spacing between each guide element 410.1 or 410.2 and a respective separating blade 49.1 or 49.2 (for setting of parameter $p_6$). The pairs of pins L1/M1, and L2/M2 (as well as L3/M3) connect the guide elements 410.1 and 410.2 (as well as 410.3), also with the transverse lever 47. The transverse lever 47, however, does not make the movement which is actuated through the lever 44 (see FIG. 4.4) as the pins L1, M1, L2, M2, L3, and M3 slide in the appropriate slots U.M1, U.L1, U.M2, U.L2, U.M3, U.L3 in the transverse lever 47. The transverse lever 47 is connected through the pin I with the lever 46, which is pivotable on the pin G. If the lever 46 is caused to swivel about the pin G, then the pin I moves in its guide V on an intermediate lever 45 in a concentric circle to the beater circle S. Thereby, the pins G and E slide in appropriate slots of the plate 43 (visible in FIG. 4.3). The transverse lever 47 joins in this movement and is thereby guided with the pin H in the appropriate slot T in the plate 43. The guide elements 410.1 and 410.2 (and 410.3) are thereby displaced, along a circle concentric to the periphery of the opening roller 24, in the direction towards the respective separating blade 49.1 or 49.2. Thereby, their radial position is not altered in relation to the opening roller 24 and in relation to the separating blades 49.1 and 49.2.

No further functions are described with reference to FIGS. 4.6, 4.7, and 4.8 but, rather, with reference to an assembly instruction, i.e., a description of the manner in which the lever unit is assembled.

FIG. 4.6 illustrates the plate 43, the lever 42 with the pin B and the intermediate lever 45, as well as the pairs of pins L1/M1, L2/M2, and L3/M3, which extend through the plate 43 and the housing 411, the points where the pairs of pins J1/K1 and J2/K2 are fastened on the side of the plate 43 facing away from the lever unit, the pin C, which is pivoted in the plate 43, the pins G, E, and H which are guided in the appropriate guides in the plate 43 and the pin I, which is pivoted in the intermediate lever 45.

In addition to the parts of the lever unit already explained in connection with FIG. 4.6, FIG. 4.7 illustrates the lever 46 and the intermediate lever 47.

In addition to the parts of the lever unit already explained in connection with FIGS. 4.6 and 4.7, FIG. 4.8 illustrates the transverse lever 48 and the lever 44.

Figure 5A:
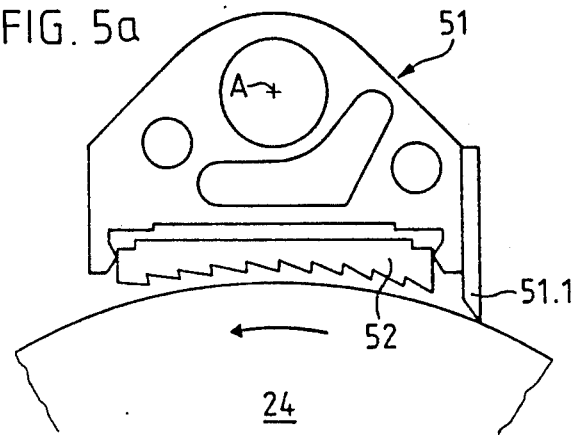
FIG. 5*a* illustrates the subject matter of FIG. 5 in greater detail.
Figure 5A:
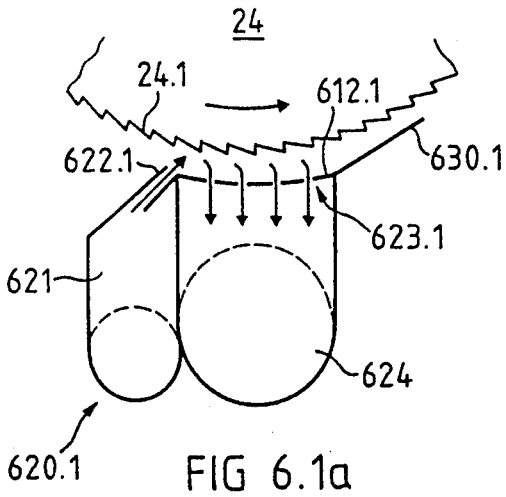
Figure 5A:
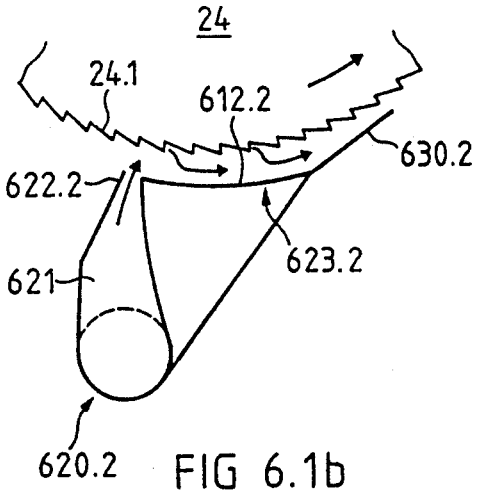

FIG. 5*a* illustrates an embodiment of the device for performing cleaning step 4, comprising a carding plate 51.

The penetration depth of the card clothing 52 in the bat (cleaning parameter $p_8$) is set through the variation of the spacing between the carding plate 51 and the opening roller 24, through displacement along the radial extension of the opening roller 24. The gradient of the intensity of the carding (cleaning parameter $p_9$) is set by turning the entire carding plate 51 about the pivot axis A. Thereby, the transit gap, which is wedge-shaped, is set to be convergent or divergent in the conveying direction.

As a variant embodiment, the front edge 51.1 of the carding plate 1 can be formed as a separating blade and can assume the role of a third separating blade in connection with the previous cleaning step which includes a group of guide elements and separating blades.

FIGS. 6.1*a* and 6.1*b* schematically illustrate two embodiments of the device for the regrouping step (cleaning step 5). These figures show a section of the opening roller 24, taken vertically or perpendicular to its axis, with teeth 24.1. The device 620.1 or 620.2 for performing the regrouping step is fitted on the side of the fiber bat opposite to the teeth 24.1. It has one slot-shaped guided nozzle 622.1 or 622.2, parallel to the axis of the opening roller, and one brake plate 623.1 or 623.2, arranged in the transport direction of the fiber bat directly behind the nozzle, and a guide plate 630.1 or 630.2, both of which likewise extend over the entire width of the opening roller 24.

For the first phase of the regrouping step, the nozzles 22.1 or 622.2 provide the air blown against the teeth 24.1. The nozzle 622.1 or 622.2 is, in turn, connected over its entire length, with an air duct 621, for example, which is described in more detail in connection with FIGS. 6.2 and 6.3. FIGS. 6.1*a* and 6.1*b* show the nozzle in two possible embodiments: the nozzle 622.1 is formed in such a way that it produces a stream of air which forms an acute angle (FIG. 6.1*a*) with the direction of transport, while the air stream from the nozzle 622.2 is arranged vertically, or more closely vertically, to the surface of the opening roller 24 (FIG. 6.1*b*). However, although differing angles are shown between the air stream from the respective nozzles 622.1 and 622.2 and the general transport direction, they have no substantial influence on the functioning of the regrouping step.

For the second phase of the regrouping step, the movement of the fiber material away from the conveying means and its braking on the opposite side, a brake plate 623.1 or 623.2 with a brake surface 612.1 or 612.2 facing towards the transport stream is arranged directly after the nozzle 622.1 or 622.2 in such a way that the surface of the opening roller 24 and the brake surface 612 together form a channel, preferably having a constant width, in the direction of transport. The brake plate 623.1 is interrupted, for example, perforated, in the embodiment shown in FIG. 6.1*a*, and is arranged over suction channel 624, so that the air can be sucked out through the perforations, whereby the aerodyamic force against the braking surface 612.1 is produced.

The suction channel 624 extends under the brake plate 623.1 over the entire width of the transport roller and is described in greater detail in connection with FIGS. 6.2 and 6.3. The relationship between the air blown through the nozzle 622.1 and the air sucked through the brake plate 623.1 is an adjustable variable of the regrouping point. More or less air can be blown in than is sucked out, or the quantities can be the same. If more air is sucked out, then an underpressure condition results over the brake surface 612.1 and particles of dirt are also sucked through the holes in the brake plate 623.1. In the latter event, the regrouping point assumes a cleaning function in addition to its regrouping function.

The embodiment of the device according to the invention represented in FIG. 6.1*b* does not have interruptions, but rather a continuous brake plate 623.2. The aerodynamic forces directed against the brake surface 612.2 in this case are only produced through the air from nozzle 622.2 reflected from the surface of the opening roller 24 and, particularly, through the teeth 24.1.

Variations of the embodiments represented in FIGS. 6.1 and 6.2 are contemplated. For example:

the variations of the nozzles 622.1, 622.2, represented in FIGS. 6.1*a* and 6.1*b* and the brake plates 623.1, 623.2, can be combined with each other; and the guide plate 630.1 or 630.2 can be omitted (for specific embodiments of which the first element of the subsequent cleaning step is a guide plate).

The braking effect on the brake surface 612.1 or 612.2 is effected through friction between the fiber material and the braking surface and is supported through the interruptions in the brake plate 623.1, or through a special surface design of a continuous brake plate 623.2, for example, with grooves running perpendicular to the general transport direction. So that the braking effect on the holes will not be too great such that the fibers are not only braked but are held firmly, special precautions are advantageous. The appropriate processing of the material must, for instance, ensure that the edges of the holes are absolutely burr-free on both sides of the brake plate 623.1.

FIGS. 6.2*a* and 6.2*b* are respective plan views of embodiments of the device for the regrouping step according to FIGS. 6.1*a* and 6.1*b*, but without the guide plate 630. They are arranged perpendicular to the axis of the opening roller 24 and against the outlet of the regrouping point. The direction of rotation of the opening roller 24 is given by a vertical arrow on the visible side of the roller. In FIG. 6.2*a*, the specific embodiment is represented with an interrupted brake plate 623.1 and suction channel 624 (according to FIG. 6.1*a*).

In order to produce a constant volume flow over the whole width of the opening roller through the brake plate 623.1, the suction channel 624 is positioned with a cross-section increasing uniformly or in steps towards one face of the opening roller. Appropriate configurations of the air suction channels are known, e.g., from commonly owned European Patent No. 70,377, published Jan. 26, 1983 and the cognate U.S. Pat. No. 4,432,200, granted Feb. 21, 1984 the disclosure of which is hereby incorporated by reference in its entirety. On the face in which the cross section is large, the suction channel 624 is connected to an extraction unit (not shown). On the other face, there can be provided an air opening 640 in communication therewith, which can be provided with an adjustable throttle 641. Through the air opening 640, enough scavenging air is admitted so that any particles of dirt sucked in are transported without separation through the extraction channel 624. In FIG. 6.2*a*, the air inlet channel 621 is likewise connected to an appropriate fan or similar source of air current on the face of the opening roller. The cross section of the air inlet channel 621 also increases over the width of the transport roller toward the connection to the fan, so that the air speed out of the nozzle 622.1 from the fan remains substantially the same in spite of a constantly reducing quantity of air.

An additional variation would be to design the air channel to be so wide that it achieves the features or an expansion chamber, so that the air speed from the very narrow nozzle 622.1, relative to the inlet channel, is constant over the entire length of this nozzle. For the air inlet and outlet channels, variants are contemplated in that only admission and exhaustion are effected in sections out of branch channels, whereby the branch channels lead into a widening collection channel towards the connected end. An embodiment of this type, however, would appear to be disadvantageous, particularly for use in a fine cleaning machine, because of its relatively great space requirement.

FIG. 6.2*b* illustrates a specific embodiment, in a view similar to that of FIG. 6.2*a*, of a device for performing the regrouping step, which has an uninterrupted brake plate 623.2 and, therefore, does not have anextraction channel, but, rather, only an air inlet channel 621. Everything previously mentioned for these air admission chanels in connection with FIG. 6.2*a* similarly applies to this specific embodiment.

FIG. 6.3 illustrates, in detail, a sectional view of the device according to the invention, facing away from the front face of the opening roller in the area of the connections, seen parallel to the axis of the opening roller. The opening roller itself is not shown, although the general direction of the air stream is indicated with a long arrow. The device again has an air inlet channel 621 with a slot-formed nozzle 622.1 and an extraction channel 624 covered by the interrupted brake plate 623.1. Both channels have a cross section increasing towards the connection front face of the transport roller. Furthermore, in this figure the means 650.1 and 650.2 are shown, with which the two partial devices for the two phases of the process are fastened on the machine part.

Figure 7A:
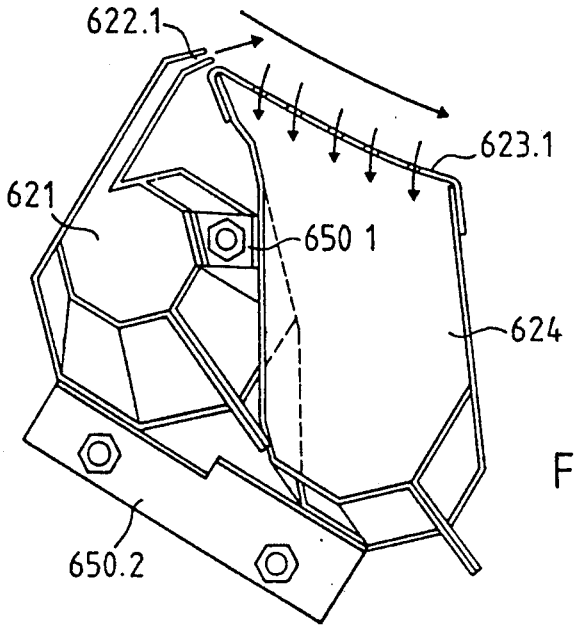
FIG. 7*a* illustrates the subject matter of FIG. 7 in greater detail.
Figure 7A:
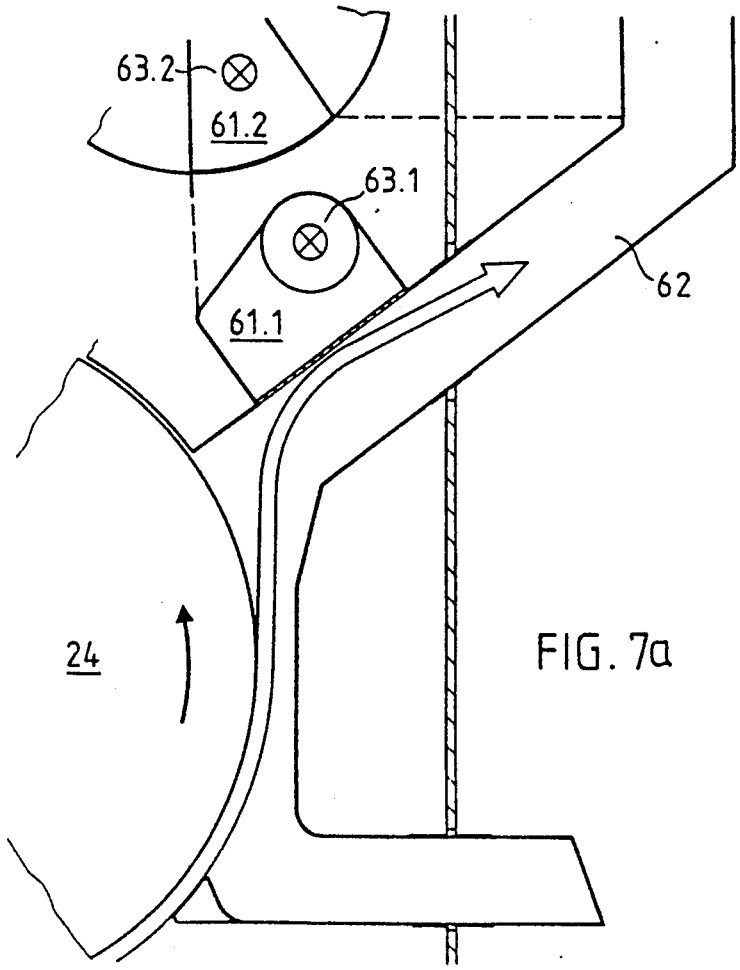

FIG. 7*a* illustrates an embodiment of the device for performing cleaning step 7, and for effecting the emergence lo of the bat from the fine cleaning machine. In this cleaning step, the bat is freed from fiber fragments (mainly dust) before it is passed to the card, for example. The screening effect is achieved through a separating element, either 61.1 or 61.2 along which the bat is further driven through its own movement. The variants appear in the drawing: the separating element 61.1, a screen hole plate limiting the channel 62 with an extraction channel 63.1, or the separating element 61.2, a screen hole plate, likewise limiting the channel 62 which, however, merges into the feed drum 23, and has an extraction channel 63.2 arranged there. A dashed line shows a limitation, which naturally, is adequately dimensioned from the viewpoint of current technology and is not as shown here. The drawing only shows that different embodiments can achieve the object of the invention, whereby the difference can lie in the energy required for the process, for instance.

Figure 8:
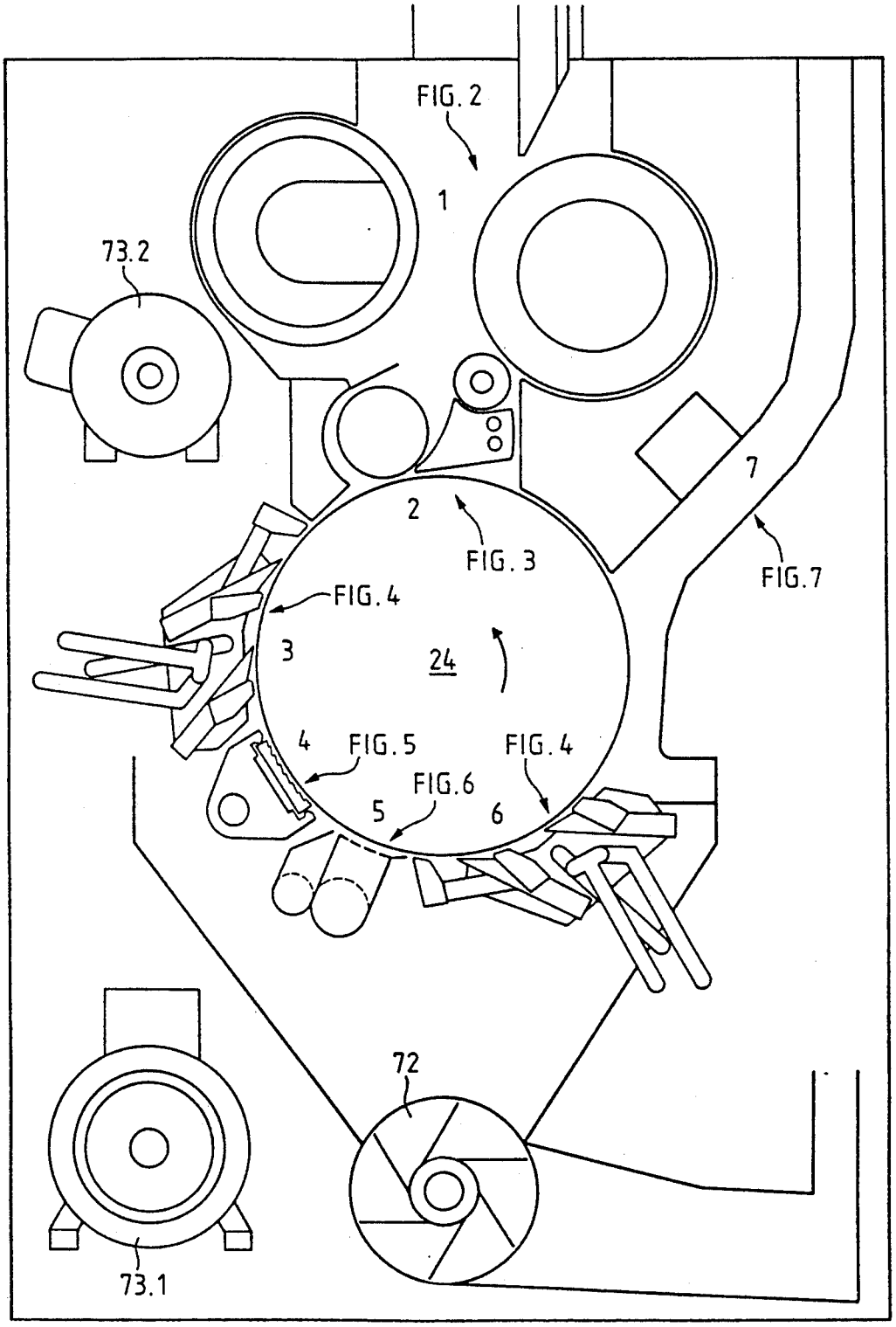
FIG. 8 is a schematic illustration of the entire cleaning apparatus.

In summary, FIG. 8 schematically illustrates the entire machine with all the cleaning devices which can be arranged in this fine cleaning machine, for example. In addition, reference is given in FIG. 8 to the appropriate figures of the individual cleaning steps 1 to 7, previously described.

A schematically represented device can also be seen for the discharge of the accumulated contamination particles from the cleaning steps 3, 5, and 6, which is arranged in the gravitational direction on the base of the machine. Reference is made to the Swiss Patent Application No. 2613/89 and the cognate U.S. Pat. No. 5,033,166, granted Jul. 25, 1991 for the removal of waste, the contents of which are assumed to be known. The device mentioned in the above-mentioned patent for discharging fiber waste from a fine cleaning machine is equipped with a means which permit the retention of a layer of waste in a collecting basin which acts as a sluice layer between the machine inner chamber and the outer chamber. The sluice layer prevents a disturbance of the aerodynamic cleaning process through infiltrated air from the discharge device.

An embodiment of the discharge, which is shown in FIG. 8, consists in that the accumulated contamination particles are discharged from the cleaning system with a sluice roller 72 running at a constant speed and are then withdrawn by suction. So that infiltrated air cannot reach the cleaning system from the suction of the contamination particles, the suction is arranged perpendicularly to the direction of discharge of the sluice roller 72.

The various drums and rollers are driven through three prime movers or motors. The main motor 73.1 in this regard is provided with a frequency converter and drives the opening roller 24. The second motor 73.2, likewise provided with a frequency converter, drives the screening drum 23, the dummy drum 22, the doffer roll 31 and the feed roller 32. The rotational speeds of the two motors are adjustable independently of each other. In other words, this means that the relationship of the peripheral speeds of the rollers driven from the second motor remain constant. Further, the relationship of the peripheral speeds of these rollers to the peripheral speed of the opening roller 24 is variable. The third motor, which is not shown in FIG. 8, drives the sluice roller 72.

Possible variants of the fine cleaning device represented in FIG. 8 are contemplated in that the cleaning steps 3, 4, 5, and 6 are not required to be arranged in the sequence represented in the transport direction of the bat. For instance, it is conceivable that the carding step could follow after the regrouping point, or could be arranged after the cleaning step 6. The carding step can also be omitted.

Finally, although the invention has been described with reference of particular means, materials and embodiments, it is to be understood that the invention is not limited to the particulars disclosed and extends to all equivalents within the scope of the claims.

What is claimed is:

1. A method of cleaning textile fibers in a cleaning machine having a fiber bat feeding device and a rotating opening roller for conveying said fiber bat in a transport direction, said method comprising the steps of:

(a) Conveying said textile fibers from an inlet to a clamping point proximate said opening roller;

(b) compressing and clamping said textile fibers, in the form of a fiber bat, with a clamping force, said clamping force having a magnitude which is a function of a characteristic of said fiber bat;

(c) drawing said fiber bat from said clamping point to a takeover point on a periphery of said opening roller, wherein said fiber bat is then subjected to a centrifugal force due to the rotation of said opening roller;

(d) performing said step (c) of drawing said fiber bat as a function of at least any one of fiber length and fiber strength;

(e) said clamping point and said takeover point being spaced apart by a predetermined distance, said predetermined distance being set as a function of said fiber length, whereby said fibers are drawn out of said fiber bat in a partially drawn fiber condition;

(f) conveying said fiber bat, while subjected to said centrifugal force, to a separation blade;

(g) separating an area of said fiber bat having contaminants concentrated therein resulted from said centrifugal force and from said drawing of said fiber bat; and (h) moving said clamping point to thereby change said distance by which said clamping point and said takeover point are spaced apart.

2. The method of claim 1, wherein said magnitude of said clamping force is set as a function of said strength of said fibers, whereby said fibers are drawn out of said fiber bat in a partially drawn fiber condition.

3. The method of claim 1, wherein said cleaning machine comprises a compression plate, tapering in said transport direction of said fiber bat to an outlet of said compression plate, said outlet defining said clamping point, and wherein said step of compressing and clamping said fiber bat comprises clamping said fiber bat at said outlet of said compression plate.

4. The method of claim 3, further comprising the step of setting said magnitude of said clamping force as a function of said fiber strength.

5. The method of claim 1, further comprising the step of deflecting said fiber bat radially inwardly, with respect to said opening roller, in opposition to said centrifugal force.

6. The method of claim 5, wherein said cleaning machine comprises at least one adjustable guide element, and wherein said step of deflecting said fiber bat comprises adjustably sliding said at least guide element in a direction toward said fiber bat.

7. The method of claim 6, wherein said cleaning machine comprises at least one adjustable separating blade, following a respective one of said at least one guide element, with respect to said transport direction of said fiber bat, and wherein said step of separating an area of said fiber bat is performed by said at least one adjustable separating blade.

8. The method of claim 1, wherein said cleaning machine comprises at least one guide element, at least one adjustable separating blade following said at least one guide element with respect to said transport direction of said fiber bat, and wherein said step of separating an area of said fiber bat is performed by said at least one adjustable separating blade.

9. The method of claim 8, wherein said at least one adjustable separating blade comprises at least two separating blades, following said guide element, with respect to said transport direction of said fiber bat, said method further comprising simultaneously adjusting a position of said two separating blades.

10. The method of claim 1, further comprising the step of carding and re-drawing said fiber bet, thereby arranging the fibers of said fiber bat generally parallel to each other.

11. The method of claim 10, further comprising a fiber-independent drawing step, whereby the fibers of said fiber bat are arranged in parallel.

12. The method of claim 11, whereby said fiber-independent drawing step is performed by means of a carding element.

13. The method of claim 12, wherein said step of separating an area of said fiber bat is performed after said fiber-independent drawing step, as a result of which, together with said centrifugal force, said contaminants are caused to move to a radial outward area of said fiber bat.

14. The method of claim 1, further comprising a final step of separating dust and fiber fragments from said fiber bat.

15. The method of claim 1, comprising at least two cleaning steps, said method further comprising the step of regrouping fibers of said fiber bat between said two cleaning steps.

16. The method of claim 15, further comprising a step of carding said fiber bat, wherein said step of regrouping is performed after said step of carding.

17. The method of claim 15, wherein said step of regrouping comprises a first phase, in which an air current is directed toward said periphery of said opening roller, and a second phase, following said first phase with respect to said transport direction, in which (i) an air current is directed away from said opening roller, and (ii) said fiber bat is mechanically braked on a surface facing away from said opening roller.

18. The method of claim 1, further comprising the step of regrouping fibers of said fiber bat, and the step of regrouping fibers of said fiber bat entailing loosening portions of the fiber bat, braking the loosened portions of the fiber bat, and having the loosened braked portions of the fiber bat overtaken in the transport direction of the fiber bat by other portions of the fiber bat.

19. A method of cleaning textile fibers in a cleaning machine having a fiber bat feeding device and a rotating opening roller for conveying said fiber bat in a transport direction, said method comprising the steps of:

(a) conveying said textile fibers from an inlet to a clamping point proximate said opening roller;
(b) compressing and clamping said textile fibers, in the form of a fiber bat, with a clamping force, said clamping force having a magnitude which is a function of a characteristic of said fiber bat;
(c) drawing said fiber bat from said clamping point to a takeover point on a periphery of said opening roller, wherein said fiber bat is then subjected to a centrifugal force due to the rotation of said opening roller;
(d) conveying said fiber bat, while subjected to said centrifugal force, to a separating blade;
(f) separating an area of said fiber bat having contaminants concentrated therein resulting from said centrifugal force and from said drawing of said fiber bat;
(g) regrouping fibers of said fiber bat between two cleaning steps;
(h) carding said fiber bat;
(i) said step of regrouping being performed after said step of carding; and
(j) said step of regrouping comprises a first phase, in which an air current is directed toward said periphery of said opening roller, and a second phase, following said first phase with respect to said transport direction, in which (i) an air current is directed away from said opening roller, and (ii) said fiber bat is mechanically baked on a surface facing away from said opening roller.

20. The method of claim 19, wherein said air current of said first phase of said regrouping step is generated via a slit-shaped nozzle.

21. The method of claim 19, wherein said step of mechanically braking said fiber bat is performed by means of a braking surface having braking points, and wherein said air current of said second phase of said regrouping step is generated by withdrawing air through perforations in said braking surface, proximate said braking points.

22. The method of claim 19, wherein said magnitude of said clamping force is set as a function of a strength of said fibers, whereby said fibers are drawn out of said fiber bat in a partially drawn fiber condition.

23. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) said means for clamping comprises a feed plate and a feed roller, said feed plate having an outlet portion, said fiber bat to be fed between said feed roller and said outlet portion of said feed plate, thereby defining said clamping point;

(d) said means for clamping further comprises means for adjusting a distance between said feed plate and said feed roller;

(e) means for adjusting said location of said clamping point in relation to said opening roller;

(f) said means for adjusting comprises means for mounting said feed plate for pivotable movement about an axis extending parallel to an axis of rotation of said feed roller;

(g) said means for adjusting further comprises means for applying a resilient biasing force to said feed roller in a direction toward said feed plate;

(h) means for drawing said fiber bat from said clamping point to a takeover point on a periphery of said opening roller, wherein said fiber bat is then subjected to a centrifugal force due to the rotation of said opening roller; and (i) means for separating an area of said fiber bat having contaminants concentrated therein resulting from said centrifugal force and from said drawing of said fiber bat.

24. The apparatus of claim 23, wherein said means for applying a resilient biasing force to said feed roller comprises means for adjusting said resilient biasing force during operation of said apparatus.

25. The apparatus of claim 23, wherein said means for separating comprises at least two separating blades, said apparatus further comprising at least two guide elements, at least one of said two guide elements being positioned between said separating blades, said guide elements serving to deflect said fiber bat radially inwardly, with respect to said opening roller, in opposition to said centrifugal force, and means for positionally adjusting respective ones of said guide elements with respect to said opening roller.

26. The apparatus of claim 25, wherein one of said guide elements is positioned in front of said separating blades, in relation to said transport direction.

27. The apparatus of claim 23, further comprising means carding plate located subsequent to said means for separating, with respect to said transport direction.

28. The apparatus of claim 27, wherein said carding plate is formed as a separating blade.

29. The apparatus of claim 27, further comprising means for radially positionally adjusting said carding plate, with respect to said opening roller.

30. The apparatus of claim 27, further comprising a regrouping point subsequent to said carding plate, with respect to said transport direction.

31. The apparatus of claim 23, further comprising a regrouping point.

32. The apparatus of claim 23, comprising a further arrangement of separating blades and guide elements as a final means for fiber separation, with respect to said transport direction.

33. The apparatus of claim 23, further comprising means for discharging waste comprising a sluice wheel, means for constantly driving said sluice wheel about on axis of rotation, and means for periodically creating an air current for extracting said waste from an area proximate said sluice wheel in a direction generally perpendicular to said axis of rotation of said sluice wheel.

34. The apparatus of claim 23, comprising a further means for cleaning fiber, comprising an air suction channel for withdrawing air from proximate said opening roller.

35. The apparatus of claim 34, further comprising a fiber bat outlet channel, wherein said air suction channel is in communication with said fiber bat outlet channel.

36. The apparatus of claim 23, wherein said means for feeding textile fibers comprises a screening drum mounted proximate a fiber inlet conduit, said apparatus comprising a further means for cleaning fiber comprising a screen and means for providing an air current directed through said screen and through a sector of said screening drum.

37. The apparatus of claim 23, in combination with said opening roller.

38. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) said means for clamping comprises a feed plate and a feed roller, said feed plate having an outlet portion, said fiber bat to be fed between said feed roller and said outlet portion of said feed plate, thereby defining said clamping point;

(d) means for adjusting said location of said clamping point in relation to said opening roller;

(e) means for drawing said fiber bat from said clamping point to a takeover point on a periphery of said opening roller, wherein said fiber bat is then subjected to a centrifugal force due to the rotation of said opening roller;

(f) means for separating an area of said fiber bat having contaminants concentrated therein resulting from said centrifugal force and from said drawing of said fiber bat;

(g) means for applying a resilient biasing force against said feed plate in a direction toward said feed roller; and (h) means for adjusting said resilient biasing force during operation of said apparatus.

39. The apparatus of claim 38, wherein said means for separating comprises at least two separating blades, said apparatus further comprising at least two guide elements, at least one of said two guide elements being positioned between said separating blades, said guide elements serving to deflect said fiber bat radially inwardly, with respect to said opening roller, in opposition to said centrifugal force, and means for positionally adjusting respective ones of said guide elements with respect to said opening roller.

40. The apparatus of claim 38, further comprising a carding plate located subsequent to said means for separating, with respect to said transport direction.

41. The apparatus of claim 38, further comprising a regrouping point.

42. The apparatus of claim 38, further comprising means for discharging waste comprising a sluice wheel, means for constantly driving said sluice wheel about an axis of rotation, and means for periodically providing an air current for extracting said waste from an area proximate said sluice wheel in a direction generally perpendicular to said axis of rotation of said sluice wheel.

43. The apparatus of claim 38, comprising a further means for cleaning fiber comprising an air suction channel for withdrawing air from proximate said opening roller.

44. The apparatus of claim 38, wherein said means for feeding textile fibers comprises a screening drum mounted proximate a fiber inlet conduit, said apparatus comprising a further means for cleaning fiber comprising a screen and means for providing an air current directed through said screen and through a sector of said screening drum.

45. The apparatus of claim 38, in combination with said opening roller.

46. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) said means for clamping comprises a feed plate and a feed roller, said feed plate having an outlet portion, said fiber bat is fed between said feed roller and said outlet portion of said feed plate, thereby defining said clamping point;

(d) means for adjusting a location of said clamping point in relation to said opening roller;

(e) means for drawing said fiber bat from said clamping point to a takeover point on a periphery of said opening roller, wherein said fiber bat is then subjected to a centrifugal force due to the rotation of said opening roller;

(f) means for separating an area of said fiber bat having contaminants concentrated therein resulting from said centrifugal force and from said drawing of said fiber bat; and (g) said means for separating comprising at least two separating blades;

(h) at least two guide elements, at least one of said two guide elements being positioned between said separating blades, said guide elements deflecting said fiber bat radially inwardly, with respect to said opening roller, in opposition to said centrifugal force;

(i) means for positionally adjusting respective ones of said guide elements with respect to said opening roller; and (j) means for adjusting a position of said separating blades radially with respect to said opening roller, said adjusting means comprising a system of levers.

47. The apparatus of claim 46, further comprising means for adjustably connecting said means for adjusting said guide elements and said means for adjusting said separating blades for adjustable movement of said guide elements and said separating blades.

48. The apparatus of claim 47, further comprising means for providing adjustable radial movement, with respect to said opening roller, of said guide elements independently of the movement of said separating blades, said means for providing adjustable movement of said guide elements comprising a further system of levers.

49. The apparatus of claim 48, further comprising means for adjusting a distance between respective guide elements and separating blades.

50. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) means for adjusting a location of said clamping point in relation to said opening roller;

(d) means for drawing said fiber bat from said clamping point to a takeover point on a periphery of said opening roller, wherein said fiber bat is then subjected to a centrifugal force due to the rotation of said opening roller;

(e) means for separating an area of said fiber bat having contaminants concentrated therein resulting from said centrifugal force and from said drawing of said fiber bat;

(f) a carding plate located subsequent to said means for separating, with respect to said transport direction; and (g) means for pivotally mounting said carding plate for providing variation in a gap provided between said carding plate and said opening roller, between a convergent gap of a predetermined amount and a divergent gap of a predetermined amount, with respect to said transport direction.

51. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) means for adjusting a location of said clamping point in relation to said opening roller;

(d) means for drawing said fiber bat from said clamping point to a takeover point on a periphery of said opening roller, wherein said fiber bat is then subjected to a centrifugal force due to the rotation of said opening roller;

(e) means for separating an area of said fiber bat having contaminants concentrated therein resulting from said centrifugal force and from said drawing of said fiber bat;

(f) a regrouping point; and (g) said regrouping point comprising a slit-shaped nozzle and a braking surface proximate thereto.

52. The apparatus of claim 51, further comprising an air channel positioned for communication with said slit-shaped nozzle for directing an air current toward said opening roller.

53. The apparatus of claim 51, wherein said braking surface comprises perforations, further comprising an air extraction conduit communication with said perforations.

54. An apparatus for cleaning textile fibers for use in conjunction with an opening roller to which said textile fibers are fed and around which said textile fibers are conveyed, in the form of a fiber bat, in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(c) means for adjusting a location of said clamping point in relation to said opening roller;

(d) means for drawing said fiber bat from said clamping point to a takeover point on a periphery of said opening roller, wherein said fiber bat is then subjected to a centrifugal force due to the rotation of said opening roller;

(e) means for separating an area of said fiber bat having contaminants concentrated therein resulting from said centrifugal force and from said drawing of said fiber bat;

(f) a further means for cleaning fiber comprising an air suction channel for withdrawing air from proximate said opening roller;

(g) a fiber bat outlet channel;

(h) said air suction channel being in communication with said fiber bat outlet channel;

(i) said means for feeding textile fibers comprises a screening drum mounted proximate a fiber inlet conduit;

(j) a further means for cleaning fiber comprising a screen and means for providing an air current directed through said screen and through a sector of said screening drum; and (k) means for vibrating said screen.

55. An apparatus for cleaning textile fibers for use in conjunction with an opening roller to which said textile fibers are fed and around which said textile fibers are conveyed, in the form of a fiber bat moving in a transport direction, said apparatus comprising:

(a) means for feeding said textile fibers to said opening roller;

(b) means for clamping said fiber bat with a predetermined magnitude of clamping force at a clamping point at a predetermined location in relation to said opening roller;

(e) means for adjusting a location of said clamping point in relation to said opening roller;

(h) means for drawing said fiber bat from said clamping point to a takeover point on a periphery of said opening roller, wherein said fiber bat is then subjected to a centrifugal force due to the rotation of said opening roller;

(i) means for separating an area of said fiber bat having contaminants concentrated therein resulting from said centrifugal force and from said drawing of said fiber bat; and (f) means for providing a regrouping point following the separating means in the transport direction of the fiber bat for regrouping fibers of said fiber bat by loosening portions of the fiber bat, braking the loosened portions of the fiber bat, and having the loosened braked portions of the fiber bat overtaken in the transport direction of the fiber bat by other portions of the fiber bat.

56. The apparatus of claim 55, wherein said means for separating an area of said fiber bat comprises at least one separating blade provided upstream of the regrouping point with respect to the transport direction of the fiber bat.

57. The apparatus of claim 55, wherein said means for separating an area of said fiber bat comprises at least two separating blades, one of said at least two separating blades being provided upstream of the regrouping point and the other of said at least two separating blades being provided downstream the regrouping point with respect to the transport direction of the fiber bat.

58. The apparatus of claim 55, wherein said separating means comprises a carding plate, and said means for providing said regrouping point being located subsequent to said carding plate with respect to said transport direction of the fiber bat.

59. The apparatus of claim 55, wherein said means for providing said regrouping point comprises a slit-shaped nozzle and a braking surface proximate thereto.

60. The apparatus of claim 59, wherein said braking surface comprises perforations, and an air extraction conduit communicating with said perforations.

61. A method of cleaning textile fibers in a cleaning machine having a fiber bat feeding device and a rotating opening roller for conveying said fiber bat in a transport direction, said method comprising the steps of:

(a) conveying said textile fibers from an inlet to a clamping point proximate said opening roller;

(b) compressing and clamping said textile fibers, in the form of a fiber bat, with a clamping force, said clamping force having a magnitude which is a function of a characteristic of said fiber bat;

(c) drawing said fiber bat from said clamping point to a takeover on a periphery of said opening roller, wherein said fiber bat is then subjected to a centrifugal force due to the rotation of said opening roller;

(d) conveying said fiber bat, subjected to the action of said centrifugal force, to a cleaning element;

(e) separating by means of the cleaning element an area of said fiber bat having contaminants concentrated therein resulting from said centrifugal force and from said drawing of said fiber bat;

(f) regrouping fibers of said fiber bat after performing the separating step (e); and (i) said step of regrouping comprises a first phase, in which an air current is directed toward said periphery of said opening roller, and a second phase, following said first phase with respect to said transport direction of the fiber bat, in which (i) an air current is directed away from said opening roller, and (ii) said fiber bat is mechanically braked on a surface facing away from said opening roller.

62. The method of claim 61, further comprising the step of subjecting the fibers of the fiber bat to at least two cleaning steps, and regrouping fibers of said fiber bat between the at least two cleaning steps.

63. The method of claim 61, wherein the separating step includes carding the fiber bat, and the step of regrouping fibers of the fiber bat is performed after carding of the fiber bat.

64. The method of claim 61, further including the step of generating said air current of said first phase of said regrouping step by means of a slit-shaped nozzle.

65. The method of claim 61, wherein said step of mechanically braking said fiber bat is performed by means of a braking surface having braking points, and wherein said air current of said second phase of said regrouping step is generated by withdrawing air through perforations in said braking surface, proximate said braking points.

66. The method of claim 61, further comprising the step of using as the cleaning element at least one separating blade.

67. A method of cleaning textile fibers in a cleaning machine having a fiber bat feeding device and a rotating opening roller for conveying said fiber bat in a transport direction, said method comprising the steps of:

(a) conveying said textile fibers from an inlet to a clamping point proximate said opening roller;

(b) compressing and clamping said textile fibers, in the form of a fiber bat, with a clamping force, said clamping force having a magnitude which is a function of a characteristic of said fiber bat;

(c) drawing said fiber bat from said clamping point to a takeover on a periphery of said opening roller, wherein said fiber bat is then subjected to a centrifugal force due to the rotation of said opening roller;

(d) conveying said fiber bat, subjected to the action of said centrifugal force, to a cleaning element;

(e) separating by means of the cleaning element an area of said fiber bat having contaminants concentrated therein resulting from said centrifugal force and from said drawing of said fiber bat;

(f) regrouping fibers of said fiber bat after performing the separating step (e); and (g) said step of regrouping fibers of said fiber bat entailing loosening portions of the fiber bat, braking the loosened portions of the fiber bat, and having the loosened braked portions of the fiber bat overtaken in the transport direction of the fiber bat by other portions of the fiber bat.

* * * * *